US006181999B1

(12) United States Patent
Yamamoto et al.

(10) Patent No.: US 6,181,999 B1
(45) Date of Patent: Jan. 30, 2001

(54) DOZING DEVICE FOR BULLDOZER

(75) Inventors: Shigeru Yamamoto; Hidekazu Nagase, both of Hirakata (JP)

(73) Assignee: Komastsu Ltd., Tokyo (JP)

( * ) Notice: Under 35 U.S.C. 154(b), the term of this patent shall be extended for 0 days.

(21) Appl. No.: 09/230,951

(22) PCT Filed: Aug. 22, 1997

(86) PCT No.: PCT/JP97/02930

§ 371 Date: Feb. 4, 1999

§ 102(e) Date: Feb. 4, 1999

(87) PCT Pub. No.: WO98/11303

PCT Pub. Date: Mar. 19, 1998

(30) Foreign Application Priority Data

Sep. 13, 1996 (JP) ..... 8-243697

(51) Int. Cl.[7] ..... G06F 7/70; G06F 19/00

(52) U.S. Cl. ..... 701/50; 172/4.5; 172/9; 414/699

(58) Field of Search ..... 701/1, 50; 172/4.5, 172/7, 9; 414/699, 700

(56) References Cited

U.S. PATENT DOCUMENTS 5,462,122 * 10/1995 Yamamoto et al. ..... 701/50
5,694,317 * 12/1997 Nakagami et al. ..... 701/50
5,819,190 * 10/1998 Nakagami et al. ..... 701/50

* cited by examiner

*Primary Examiner*—William A. Cuchlinski, Jr.
*Assistant Examiner*—Gertrude Arthur
(74) *Attorney, Agent, or Firm*—Armstrong, Westerman, Hattori, McLeland & Naughton

(57) ABSTRACT

A dozing system for a bulldozer capable of providing high operational efficiency in dozing operation and a smooth excavation face. If it is determined when operation is performed in an automatic digging mode that the load exerted on the blade is stable, a target position for the cutting edge relative to the ground is corrected to the actual position of the cutting edge at that time. According to the ratio of the amount of excavated soil loaded on the front surface of the blade to the loading capacity of the blade front surface and/or the stability of the load exerted on the blade, a switching is performed between a weight characteristic for the operation amount of the load control and a weight characteristic for the operation amount of the smoothing control. Further, a map for correlating actual travel distance with the position of the blade cutting edge is prepared, and stable cutting edge positions are accumulated in each respective cycle and averaged to obtain an optimum target value for the smoothing control.

10 Claims, 19 Drawing Sheets

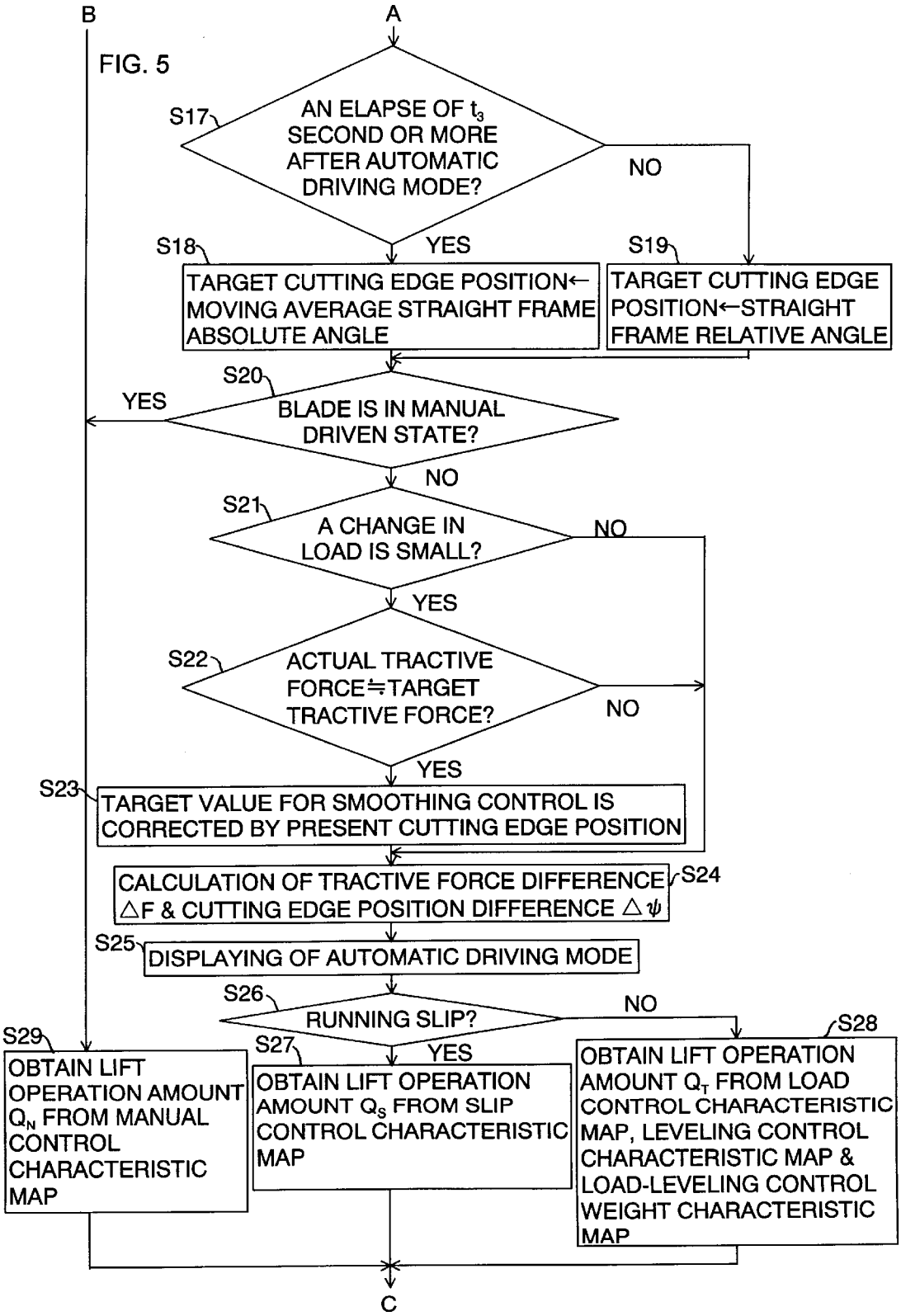
B
A
FIG. 5
S17
AN ELAPSE OF $t_3$ SECOND OR MORE AFTER AUTOMATIC DRIVING MODE?
NO
YES
S18
TARGET CUTTING EDGE POSITION← MOVING AVERAGE STRAIGHT FRAME ABSOLUTE ANGLE
S19
TARGET CUTTING EDGE POSITION←STRAIGHT FRAME RELATIVE ANGLE
S20
BLADE IS IN MANUAL DRIVEN STATE?
YES
NO
S21
A CHANGE IN LOAD IS SMALL?
NO
YES
S22
ACTUAL TRACTIVE FORCE≒TARGET TRACTIVE FORCE?
NO
YES
S23
TARGET VALUE FOR SMOOTHING CONTROL IS CORRECTED BY PRESENT CUTTING EDGE POSITION
CALCULATION OF TRACTIVE FORCE DIFFERENCE △F & CUTTING EDGE POSITION DIFFERENCE △ψ
S24
S25
DISPLAYING OF AUTOMATIC DRIVING MODE
S26
RUNNING SLIP?
NO
YES
S29
OBTAIN LIFT OPERATION AMOUNT $Q_N$ FROM MANUAL CONTROL CHARACTERISTIC MAP
S27
OBTAIN LIFT OPERATION AMOUNT $Q_S$ FROM SLIP CONTROL CHARACTERISTIC MAP
S28
OBTAIN LIFT OPERATION AMOUNT $Q_T$ FROM LOAD CONTROL CHARACTERISTIC MAP, LEVELING CONTROL CHARACTERISTIC MAP & LOAD-LEVELING CONTROL WEIGHT CHARACTERISTIC MAP
C

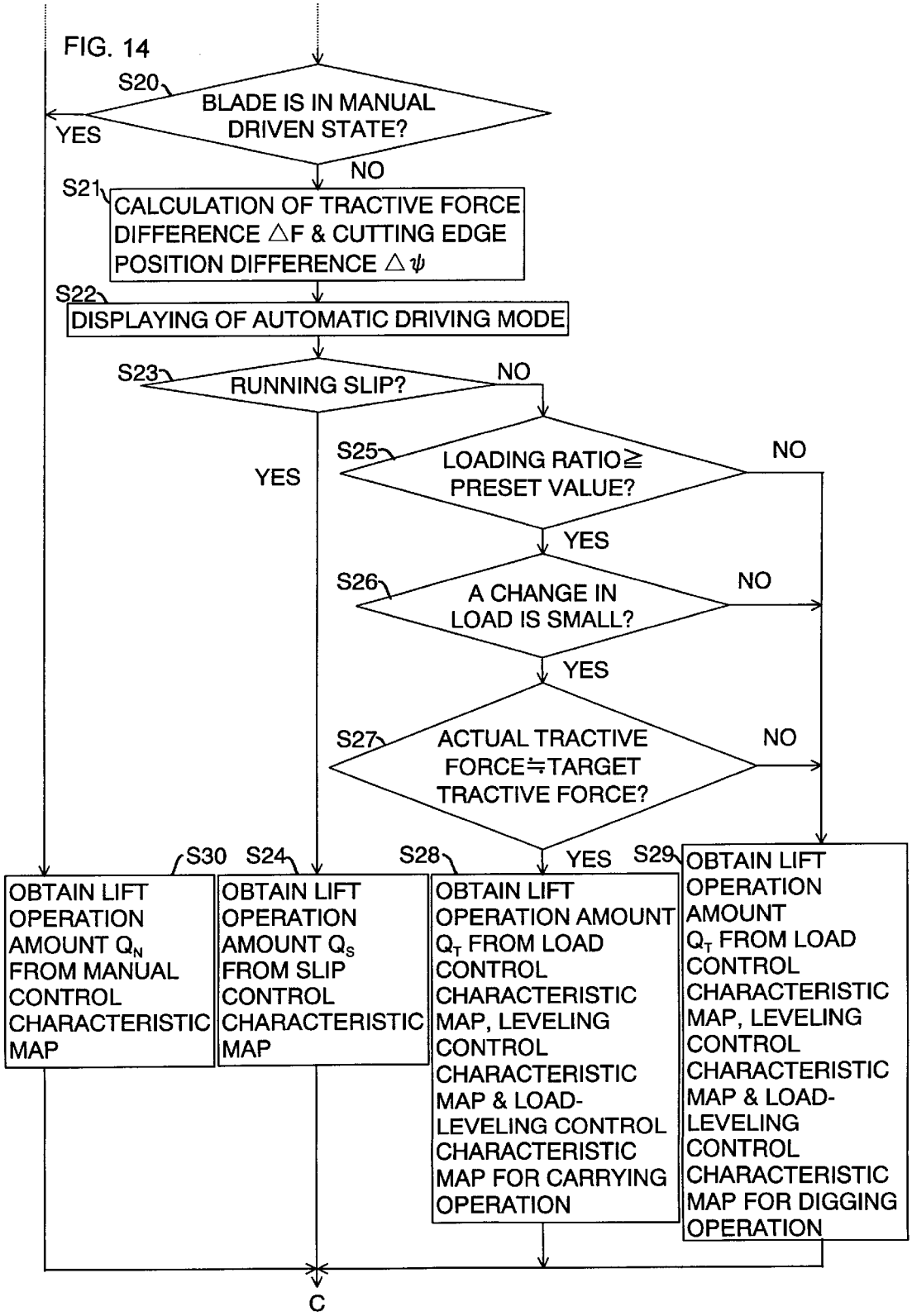
FIG. 14
S20
BLADE IS IN MANUAL DRIVEN STATE?
YES
NO
S21
CALCULATION OF TRACTIVE FORCE DIFFERENCE △F & CUTTING EDGE POSITION DIFFERENCE △ψ
S22
DISPLAYING OF AUTOMATIC DRIVING MODE
S23
RUNNING SLIP?
NO
YES
S25
LOADING RATIO≧ PRESET VALUE?
NO
YES
S26
A CHANGE IN LOAD IS SMALL?
NO
YES
S27
ACTUAL TRACTIVE FORCE≒TARGET TRACTIVE FORCE?
NO
YES
S30
OBTAIN LIFT OPERATION AMOUNT $Q_N$ FROM MANUAL CONTROL CHARACTERISTIC MAP
S24
OBTAIN LIFT OPERATION AMOUNT $Q_S$ FROM SLIP CONTROL CHARACTERISTIC MAP
S28
OBTAIN LIFT OPERATION AMOUNT $Q_T$ FROM LOAD CONTROL CHARACTERISTIC MAP, LEVELING CONTROL CHARACTERISTIC MAP & LOAD-LEVELING CONTROL CHARACTERISTIC MAP FOR CARRYING OPERATION
S29
OBTAIN LIFT OPERATION AMOUNT $Q_T$ FROM LOAD CONTROL CHARACTERISTIC MAP, LEVELING CONTROL CHARACTERISTIC MAP & LOAD-LEVELING CONTROL CHARACTERISTIC MAP FOR DIGGING OPERATION
C

DOZING DEVICE FOR BULLDOZER

TECHNICAL FIELD

The present invention relates to a dozing system well suited for use in a bulldozer and more particularly to a leveling control technique for adequately controlling the position of the cutting edge of the blade in relation to the ground during the dozing operation of a bulldozer.

BACKGROUND ART

Normally, the dozing operation of a bulldozer of the above type is carried out under manual control by the operator. Concretely, the blade is manually controlled so that digging or soil carrying is performed with the blade being lifted and lowered, or leveling is performed with the cutting edge of the blade kept in a certain position in relation to the ground.

In such manual operation to lift or lower the blade, or keep the position of the cutting edge, the operator is required to frequently manipulate the blade so that he gets tremendous fatigue, no matter how skillful he is. In addition, such manipulation is too complicated for an inexperienced operator.

As an attempt to solve this problem, the applicant of the present invention has proposed a leveling control system for a bulldozer in Japanese Patent Publication (KOKAI) No. 7-48855 (1995), which enables leveling work in dozing operation by simple manipulation without causing extreme fatigue. In this leveling control system, a lift operation amount is obtained from a load control characteristic map to make the actual tractive force of the bulldozer equal to a target tractive force, while a lift operation amount is obtained from a leveling control (smoothing control) characteristic map to make the actual position of the cutting edge relative to the ground coincident with a target cutting edge position. These lift operation amounts are respectively weighted with a value obtained from a load-leveling control weight characteristic map, based on the difference between the actual and target tractive forces and then summed, in order that a final lift operation amount is obtained.

The leveling control system of this publication, however, presents the following problem. In this system, even when the load exerted on the blade is greatly changed, a target value for the load control is corrected by a target value for the smoothing control. Therefore, upon completion of carrying operation for example, the load control is so performed as to lift the blade, whereas the smoothing control is so performed as to lower the blade to restrict the fluctuation of the target cutting edge position. Consequently, the resultant ground surface after dozing operation will be undulated.

In addition, according to the publication, the load-leveling control weighting characteristic map is always set based on a constant weight function notwithstanding changes in the working states of dozing operation, and therefore the weight function of such a map is inevitably a combination of a weight function for digging work and a weight function for carrying work. This poses an obstacle to improvements in control performance.

The above publication has a further disadvantage in that when performing digging work and carrying work a plurality of times in the same lane, a target value is reset for every cycle of dozing operation so that improvement cannot be expected from the repetitive cycles and consequently there remain difficulties in adjusting the dozing operation to soil property and working conditions which vary every excavation site.

The invention is directed to overcoming the above problems and a prime object of the invention is therefore to provide a dozing system for a bulldozer, which provides improved operational efficiency for dozing operation while achieving a smooth excavation face. A second object of the invention is to provide a dozing system for a bulldozer, which is capable of adequately setting a weight function according to whether a digging mode or carrying mode is presently selected, thereby achieving better control performance. A third object of the invention is to provide a dozing system for a bulldozer, which exhibits good conformability to variations in the conditions of every excavation site to thereby achieve improved operational efficiency.

DISCLOSURE OF THE INVENTION

The first object can be achieved by a dozing system for use in a bulldozer according to a first aspect of the invention, the dozing system comprising:

(a) cutting edge position detecting means for detecting the position of the cutting edge of a blade in relation to the ground;

(b) target cutting edge position setting means for setting a target position of the cutting edge of the blade in relation to the ground;

(c) load condition detecting means for determining whether the load exerted on the blade is in a stable state;

(d) target cutting edge position correcting means for correcting the target cutting edge position set by the target cutting edge position setting means to the actual position of the cutting edge at that time, if the load condition detecting means determines that the load exerted on the blade is in a stable state when dozing operation is performed in an automatic digging mode; and (e) blade controlling means for controlling the blade to be lifted or lowered such that the position of the cutting edge of the blade detected by the cutting edge position detecting means is made coincident with the target cutting edge position corrected by the target cutting edge position correcting means.

According to the first aspect of the invention, if it is determined when dozing operation is carried out in an automatic digging mode that the load exerted on the blade is in a stable state, in other words, if automatic digging is stably carried out, a target position of the cutting edge of the blade is corrected to the actual position of the cutting edge at that time. According to this corrected target cutting edge position, the control (smoothing control) is carried out for adjusting the position of the cutting edge of the blade in relation to the ground. With this arrangement, the blade control can be accurately carried out and improved efficiency can be achieved. In addition, automatic digging can be so performed as to flatten the face of the excavation, and it becomes possible to cope with variations in the inclination of the land and with the ground surface having irregular hardness.

In the invention, the actual position of the cutting edge used for correcting a target cutting edge position by the target cutting edge position correcting means is preferably obtained from a moving average. This enables high accuracy control.

The second object of the invention can be achieved by a dozing system for use in a bulldozer, according to the second aspect of the invention, the dozing system comprising:

(a) actual tractive force detecting means for detecting the actual tractive force of a vehicle body;

(b) cutting edge position detecting means for detecting the position of the cutting edge of a blade in relation to the ground;

(c) loading ratio detecting means for detecting a loading ratio that is the ratio of the amount of excavated soil loaded on the front surface of the blade to the loading capacity of the blade front surface;

(d) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(e) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(f) weight characteristic setting means for setting a weight characteristic for automatic digging, which gives importance to weighting of the operation amount calculated by the first operation amount calculating means rather than weighting of the operation amount calculated by the second operation amount calculating means, if the loading ratio determined by the loading ratio detecting means is below a specified value, and for setting a weight characteristic for automatic carrying, which gives importance to weighting of the operation amount calculated by the second operation amount calculating means rather than weighting of the operation amount calculated by the first operation amount calculating means, if the loading ratio determined by the loading ratio detecting means is equal to or more than the specified value; and (g) blade controlling means for controlling the blade to be lifted or lowered, using the weight characteristic set by the weight characteristic setting means.

According to the second aspect of the invention, if the ratio of the amount of excavated soil loaded on the front surface of the blade to its loading capacity, which ratio is detected in dozing operation, is smaller than a specified value, a weight characteristic for automatic digging is set. This characteristic gives importance to weighting of a control amount for the so-called load control (for controlling the blade so as to make an actual tractive force equal to a target tractive force) rather than weighting of a control amount for the so-called smoothing control (for controlling the blade so as to make the actual position of the cutting edge relative to the ground coincident with a target cutting edge position). On the other hand, if the above loading ratio is equal to or more than the specified value, a weight characteristic for automatic carrying is set. This characteristic gives importance to weighting of a control amount for the load control rather than weighting of a control amount for the smoothing control. With this arrangement, when operation is in the automatic digging mode, priority is given to the load control to reduce load errors and when operation is in the automatic carrying mode, priority is given to the smoothing control to achieve a smooth excavation face.

While switching between the weight characteristics for automatic digging and for automatic carrying is performed according to the loading ratio in the above arrangement, it may be performed according to whether or not the condition of the load exerted on the blade is stable. Accordingly, the second object of the invention can also be achieved by a dozing system for use in a bulldozer, according to the third aspect of the invention, the dozing system comprising:

(a) actual tractive force detecting means for detecting the actual tractive force of a vehicle body;

(b) cutting edge position detecting means for detecting the position of the cutting edge of a blade in relation to the ground;

(c) load condition detecting means for determining whether the load exerted on the blade is in a stable state;

(d) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(e) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(f) weight characteristic setting means for setting a weight characteristic for automatic digging, which gives importance to weighting of the operation amount calculated by the first operation amount calculating means rather than weighting of the operation amount calculated by the second operation amount calculating means, if the load condition detecting means determines that the load on the blade is not in a stable state, and for setting a weight characteristic for automatic carrying, which gives importance to weighting of the operation amount calculated by the second operation amount calculating means rather than weighting of the operation amount calculated by the first operation amount calculating means, if the load condition detecting means determines that the load on the blade is in a stable state; and (g) blade controlling means for controlling the blade to be lifted or lowered, using the weight characteristic set by the weight characteristic setting means.

According to the third aspect of the invention, if the load exerted on the blade in dozing operation is not in a stable state, a weight characteristic for automatic digging is set, which characteristic gives importance to weighting of a control amount for the load control rather than weighting of a control amount for the smoothing control. If the load exerted on the blade is in a stable state, a weight characteristic for automatic carrying is set, which characteristic gives importance to weighting of a control amount for the smoothing control rather than weighting of a control amount for the load control. Like the above-described arrangement having the second feature, the arrangement of the third aspect is made such that when automatic digging is performed, priority is given to the load control to reduce load errors, whereas when automatic carrying is performed, priority is given to the smoothing control so that the face of an excavation can be flattened.

For switching between the weight characteristics, the above loading ratio and the data on whether the load exerted on the blade is stable or not may be both used. Therefore, the second object of the invention can be achieved by a dozing system for use in a bulldozer, according to the forth aspect of the invention, the dozing system comprising:

(a) actual tractive force detecting means for detecting the actual tractive force of a vehicle body;

(b) cutting edge position detecting means for detecting the position of the cutting edge of a blade in relation to the ground;

(c) loading ratio detecting means for detecting a loading ratio that is the ratio of the amount of excavated soil loaded on the front surface of the blade to the loading capacity of the blade front surface;

(d) load condition detecting means for determining whether the load exerted on the blade is in a stable state;

(e) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(f) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(g) weight characteristic setting means for setting a weight characteristic for automatic digging, which gives importance to weighting of the operation amount calculated by the first operation amount calculating means rather than weighting of the operation amount calculated by the second operation amount calculating means, if the loading ratio determined by the loading ratio detecting means is below a specified value or if the load condition detecting means determines that the load on the blade is not in a stable state, and for setting a weight characteristic for automatic carrying, which gives importance to weighting of the operation amount calculated by the second operation amount calculating means rather than weighting of the operation amount calculated by the first operation amount calculating means, if the loading ratio is equal to or more than the specified value and the load condition detecting means determines that the load on the blade is in a stable state; and (h) blade controlling means for controlling the blade to be lifted or lowered, using the weight characteristic set by the weight characteristic setting means.

According to the forth aspect of the invention, if the ratio of the amount of excavated soil loaded on the front surface of the blade to its loading capacity, which ratio is detected in dozing operation, is smaller than a specified value or if the load exerted on the blade is not in a stable state in dozing operation, an operation amount for automatic digging is set, which gives importance to weighting of a control amount for the load control rather than weighting of a control amount for the smoothing control. If the loading ratio is equal to or more than the specified value and the load exerted on the blade is in a stable state, a weight for automatic carrying is set, which gives importance to weighting of a control amount for the smoothing control rather than weighting of a control amount for the load control. By setting a weight characteristic for automatic carrying when the requirement for the loading ratio and the stable load condition are both met, the control performance of the system can be further improved.

Where the loading ratio is used for switching between the weight characteristics, the weight characteristics may not be classified into two groups, i.e., automatic digging and automatic carrying, but may be classified into many groups according to the values of the loading ratio. Therefore, the second object can also be accomplished by a dozing system for use in a bulldozer, according to the fifth aspect of the invention, the dozing system comprising:

(a) actual tractive force detecting means for detecting the actual tractive force of a vehicle body;

(b) cutting edge position detecting means for detecting the position of the cutting edge of a blade in relation to the ground;

(c) loading ratio detecting means for detecting a loading ratio that is the ratio of the amount of excavated soil loaded on the front surface of the blade to the loading capacity of the blade front surface;

(d) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(e) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(f) weight characteristic setting means for setting an adequate weight characteristic that is retrieved from prestored data by the loading ratio detected by the loading ratio detecting means, said prestored data correlating weight characteristics for operation amounts calculated by the first operation amount calculating means and calculated by the second operation amount calculating means with a multiplicity of zones into which the value of loading ratio is stratified; and (g) blade controlling means for controlling the blade to be lifted or lowered, using the weight characteristic set by the weight characteristic setting means.

According to the fifth aspect of the invention, the value of the loading ratio of the blade front surface detected in dozing operation is stratified into a multiplicity of zones and weight characteristics corresponding to the respective zones are prestored. A weight characteristic corresponding to a loading ratio actually detected is retrieved from the prestored data, thereby setting an adequate weight characteristic. This contributes to a further improvement in control performance.

The third object can be accomplished by a dozing system for a bulldozer according to the sixth aspect of the invention, the dozing system comprising:

(a) cutting edge position detecting means for detecting the position of the cutting edge of a blade in relation to the ground;

(b) target cutting edge position setting means for setting the relationship between the actual travel distance of the bulldozer from a digging start point and target positions for the cutting edge of the blade in relation to the ground;

(c) load condition detecting means for determining whether the load exerted on the blade is in a stable state;

(d) target cutting edge position correcting means for accumulating a sequence of data on the position of the cutting edge in each dozing operation cycle when the load condition detecting means determines the load exerted on the blade is in a stable state during dozing operation carried out in an automatic driving mode, and for correcting the target cutting edge position set by the target cutting edge position setting means to a value obtained by averaging the sequence of accumulated cutting edge position data; and (e) blade controlling means for controlling the blade to be lifted or lowered such that a cutting edge position detected by the cutting edge position detecting means is made coincident with the target cutting edge position corrected by the target cutting edge position correcting means.

According to the sixth aspect of the invention, if the load exerted on the blade is stable when dozing operation is performed in an automatic driving mode, a series of data on the position of the cutting edge are accumulated. The target cutting edge position set in the period where the load is stable is corrected to a value obtained by averaging the series of accumulated data. Based on the corrected target cutting edge position, control for adjusting the position of the blade cutting edge (i.e., smoothing control) is performed. Thus, the system performs dozing operation, while learning the soil property and working conditions in the excavation site. This arrangement enables automatic dozing operation suited for working conditions which vary every site.

In the first, third, forth and sixth arrangements, it is preferable that the load condition detecting means determine that the load exerted on the blade is stable, when a change in the load on the blade is below a specified value and the load on the blade is proximate to a preset target tractive force. The magnitude of a variation in the load exerted on the blade may be detected by sensing a change in the actual tractive force of the vehicle body or alternatively by sensing a change in the position of the cutting edge of the blade relative to the ground.

BRIEF DESCRIPTION OF DRAWINGS

FIG. 5 is a flow chart of the operation of the dozing system according to the first embodiment (the second half portion).

FIG. 14 is a flow chart of the important part of the operation of the dozing system according to the first embodiment.

BEST MODE FOR CARRYING OUT THE INVENTION

Referring now to the accompanying drawings, preferred embodiments of the dozing system for a bulldozer according to the invention will be described.

FIRST EMBODIMENT

Figure 1:
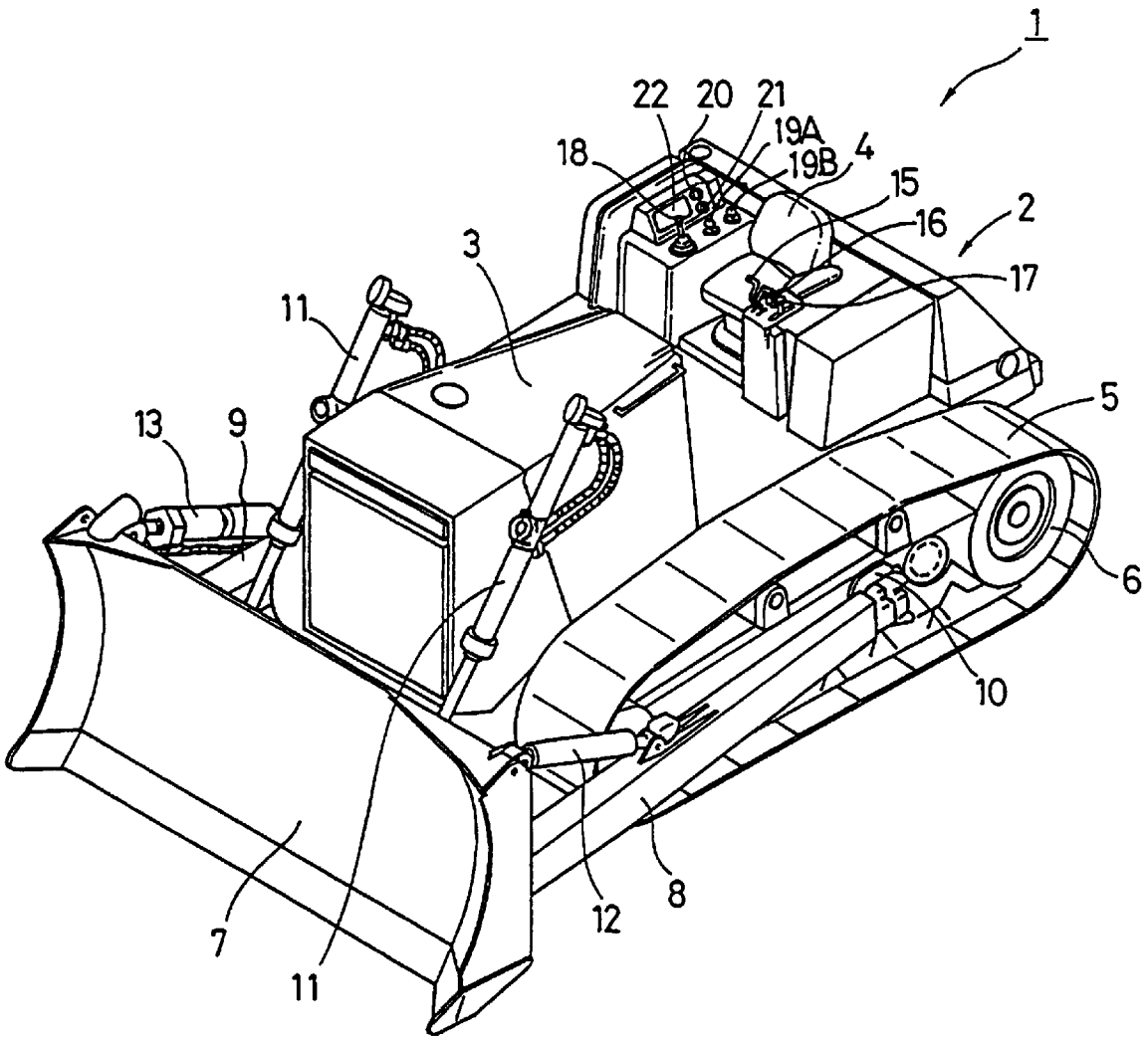
FIG. 1 is an outside view of a bulldozer, illustrated for explaining a dozing system for a bulldozer according to a first embodiment.

Referring to FIG. 1 showing an outside view of a bulldozer 1, there are provided, on a vehicle body 2, a bonnet 3 for housing an engine (not shown) and a cab 4 for the operator who drives the bulldozer 1. Disposed on both right and left sides of the vehicle body 2 when viewed in the forward moving direction of the vehicle body 2 are crawler belts 5 (the crawler belt on the right side is not shown in the drawing) for driving the vehicle body 2 so as to travel forwardly and reversely and turn. The crawler belts 5 are respectively independently driven by driving power transmitted from the engine with the aid of their corresponding sprockets 6.

A blade 7 is supported on the leading ends of right and left straight frames 8, 9 the base ends of which are, in turn, pivotally supported at the sides of the vehicle body 2 through trunnions 10 (the trunnion on the right side is not shown in the drawing) such that the blade 7 can be lifted or lowered. A pair of blade lift cylinders 11 are disposed between the blade 7 and the vehicle body 2, for lifting or lowering the blade 7. For tilting the blade 7 to the right and left, a brace 12 is disposed between the blade 7 and the left straight frame 8 and a blade tilt cylinder 13 is disposed between the blade 7 and the right straight frame 9.

A steering lever 15, a gear shift lever 16 and a fuel control lever 17 are disposed on the left side of the cab 4 when viewed in the travel direction of the vehicle body 2. On the left side of the vehicle body 2, there are provided (i) a blade control lever 18 for lifting, lowering and leftwardly and rightwardly tilting the blade 7, (ii) a first dial switch 19A for setting a value for the load of excavated soil imposed on the blade 7, (iii) a second dial switch 19B for correcting the set load value, (iv) an automatic/manual driving mode selector switch 20 for switching on and off automatic dozing operation, (v) a lock-up selector switch 21 for switching on and off the locked-up state of a torque converter and (vi) a display unit 22. There is disposed a decelerator pedal in front of the cab 4, although it is not shown in the drawing.

Figure 2:
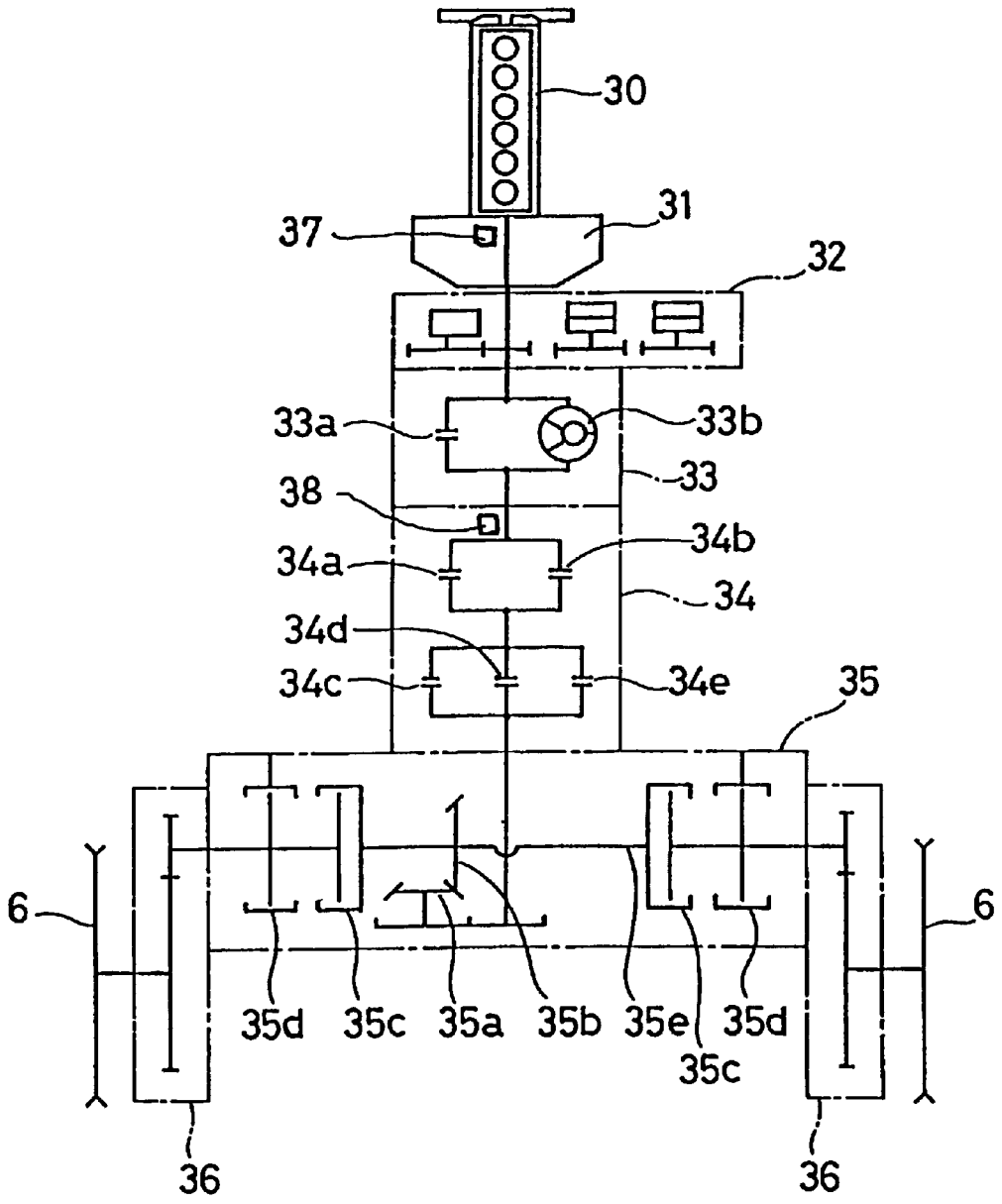
FIG. 2 is a skeleton diagram of a power transmission system adapted in the dozing system for a bulldozer according to the first embodiment.

Referring to FIG. 2 which shows a power transmission system, the rotary driving power of the engine 30 is transmitted to a damper 31 and a PTO 32 for driving various hydraulic pumps including an implement operating hydraulic pump and then to a torque converter 33 having a lock-up mechanism 33*a* and a pump 33*b*. The rotary driving power is then transmitted from the output shaft of the torque converter 33 with a lock-up mechanism to a transmission 34 (e.g., wet multiple disc clutch type planetary gear transmission) which has an input shaft connected to the output shaft of the torque converter unit 33. The transmission 34 comprises a forward drive clutch 34*a*, a reverse drive clutch 34*b* and first to third speed clutches 34*c*, 34*d*, 34*e*, so that the output shaft of the transmission 34 is rotated in three speed ranges in both forward drive and reverse drive. The rotary driving power from the output shaft of the transmission 34 is transmitted to paired right and left final reduction gear mechanisms 36 through a steering system 35 to power the respective sprockets 6 for running the crawler belts 5. The steering system 35 has a transverse shaft 35*e* having a pinion 35*a*, a bevel gear 35*b*, paired right and left steering clutches 35*c* and steering brakes 35*d*. Reference numeral 37 designates an engine speed sensor for detecting the engine speed of the engine 30 and reference numeral 38 designates a torque converter output shaft revolution sensor for detecting the revolution speed of the output shaft of the torque converter unit 33 with a lock-up mechanism.

Figure 3:
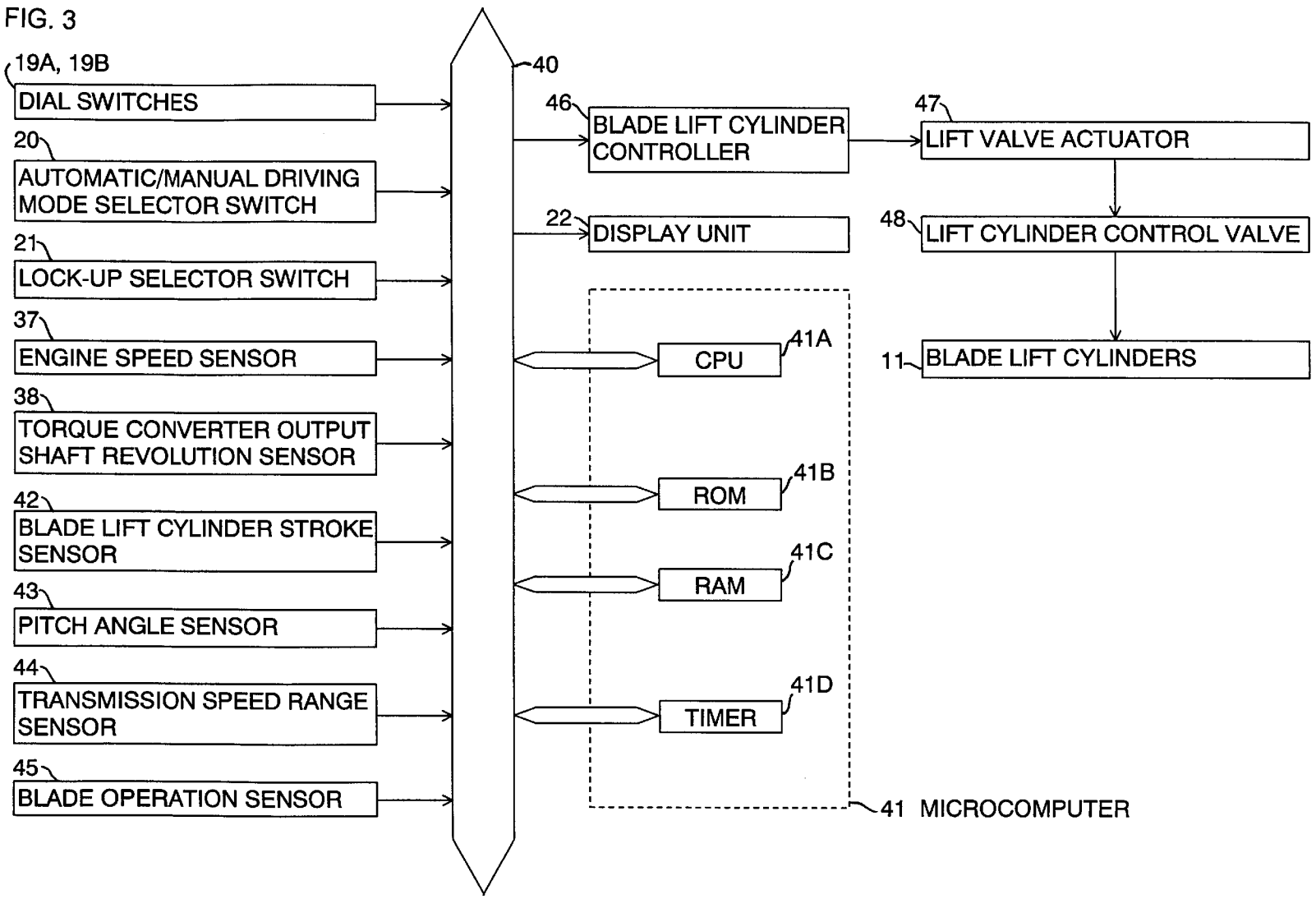
FIG. 3 is a schematic block diagram showing the system structure of the dozing system for a bulldozer according to the first embodiment.

As shown in FIG. 3 which schematically shows the system structure of the dozing system for a bulldozer of this embodiment, the following data are all input to a microcomputer 41 through a bus 40. (i) Dial value data that is representative of a set value for the load of excavated soil imposed on the blade 7 and sent from the first dial switch 19A; and dial value data that is representative of a correction value for the set load and sent from the second dial switch 19B. (ii) An automatic/manual driving mode selection instruction that is representative of whether an automatic driving mode or a manual driving mode has been selected and sent from the automatic/manual driving mode selector switch 20. (iii) A lock-up (L/U)/torque converting (T/C) selection instruction that is representative of whether or not the torque converter 33 is to be locked up and sent from the lock-up selector switch 21. (iv) Engine speed data that is representative of the engine speed of the engine 30 and sent from the engine speed sensor 37. (v) Revolution data that is representative of the revolution speed of the output shaft of the torque converter 33 and sent from the torque converter output shaft revolution sensor 38. The following data are also input to the computer 41 through the bus 40. (i) Stroke positional data sent from a blade lift cylinder stroke sensor 42 for sensing the stroke positions of the right and left blade lift cylinders 11 for lifting and lowering the blade 7. (ii) Pitch angle data sent from a pitch angle sensor 43 for sensing the momentarily changing pitch angle of the vehicle body 2 which pitches back and forward. (iii) Speed range data sent from a transmission speed change sensor 44 for sensing which speed range in the forward and reverse drive has been selected by shifting the transmission 34 with the gear shift lever 16. (iv) Manual driving operation data sent from a blade operation sensor 45 for sensing whether the blade 7 has been put in manual driving operation by operating the blade control lever 18.

The microcomputer 41 is composed of (i) a central processing unit (CPU) 41A for executing a specified program, (ii) a read only memory (ROM) 41B for storing the above program and various maps including an engine characteristic map and torque converter characteristic map, (iii) a random access memory (RAM) 41C serving as a working memory necessary for executing the program and serving as various types of registers, and (iv) a timer 41D for measuring elapsed time for an event in the program. According to (i) the dial value data representative of a set value for the load of excavated soil imposed on the blade 7 and the dial value data representative of a correction value for the set load, (ii) the automatic/manual driving mode selection instruction for dozing operation, (iii) the lock-up (L/U)/torque converting (T/C) selection instruction for the torque converter 33, (iv) the engine speed data on the engine 30, (v) the revolution data on the output shaft of the torque converter 33, (vi) the stroke positional data on the right and left blade lift cylinders 11, (vii) the pitch angle data on the vehicle body 2, (viii) the speed range data on the transmission 34, and (ix) the manual driving operation data on the blade 7, the above program is executed to provide a blade lift cylinder controller 46 with a lift operation amount to be used for lifting or lowering the blade 7. According to the lift operation amount, the right and left blade lift cylinders 11 are driven with the aid of a lift valve actuator 47 and a lift cylinder control valve 48 so that the blade 7 is lifted or lowered. The display unit 22 displays whether the bulldozer 1 is presently in the automatic driving mode or in the manual driving mode in dozing operation.

Figure 4:
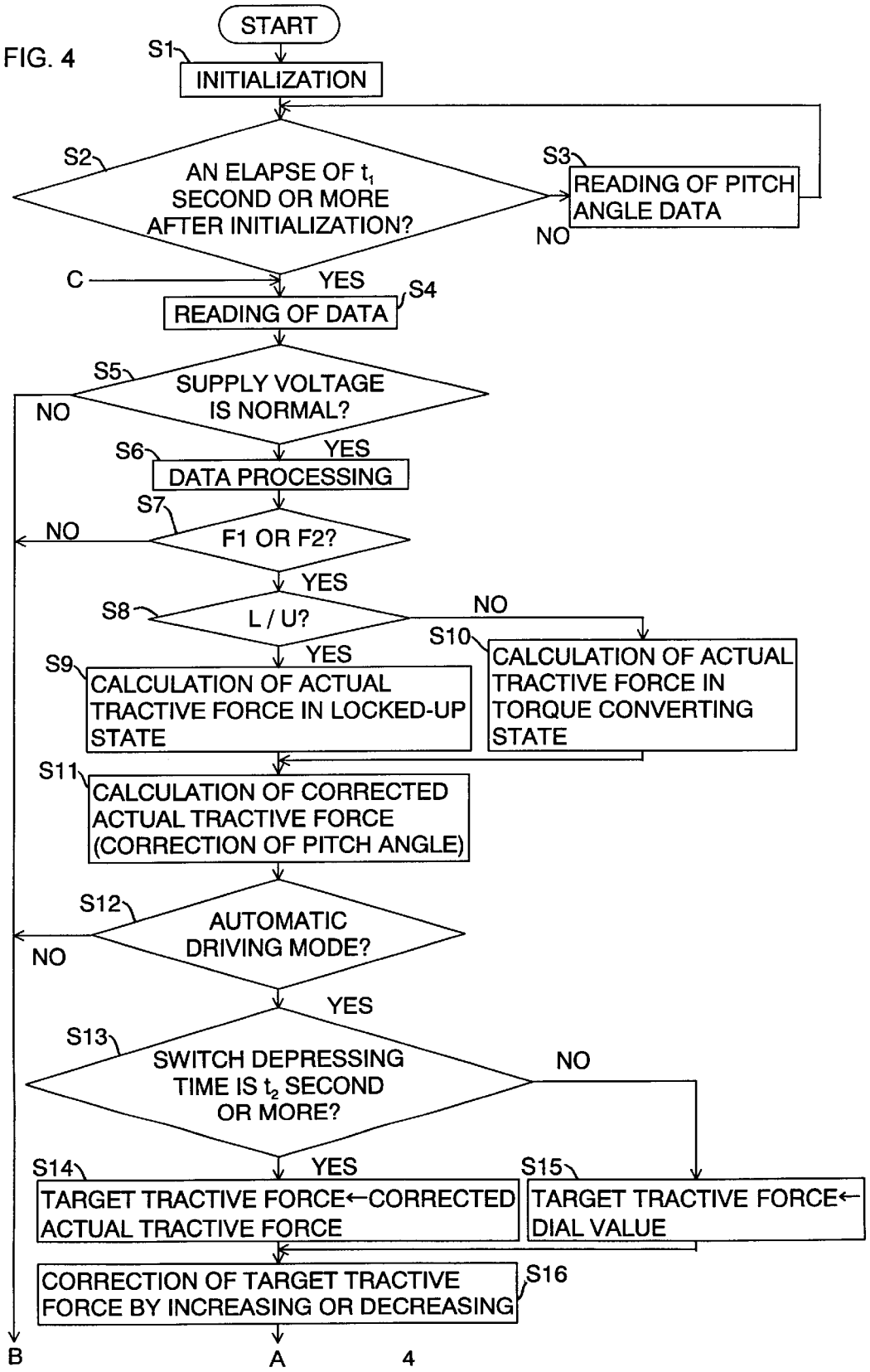
FIG. 4 is a flow chart of the operation of the dozing system according to the first embodiment (the first half portion).

Reference is now made to the flow charts of FIGS. 4 and 5 for explaining the operation of the dozing system for a bulldozer having the above structure.

S1 to S3: An execution of the specified program is started by turning on the electric power source, and initialization is done, for instance, for clearing the contents of the registers in the RAM 41C of the microcomputer 41. During the period of $t_1$ seconds after the initialization, pitch angle data pieces are successively read in from the pitch angle sensor 43 for obtaining an initial value. The reason why a sequence of data are read from the pitch angle sensor 43 is that the pitch angle of the vehicle body 2 is obtained from the frequency separation of the moving average of the pitch angle data.

S4 to S6: The dial value data representative of a set value for the load of excavated soil imposed on the blade 7 is read from the first dial switch 19A. The dial value data representative of a correction value for the set load is read from the second dial switch 19B. An instruction for selecting the automatic or manual driving mode for dozing operation is read from the automatic/manual driving mode selector switch 20. An L/U-T/C selection instruction for torque converter 33 is read from the lock-up selector switch 21. The engine speed data of the engine 30 is read from the engine speed sensor 37. The revolution data of the output shaft of the torque converter 33 is read from the torque converter output shaft revolution sensor 38. The stroke position data of the right and left blade lift cylinders 11 are read from the blade lift cylinder stroke sensor 42. The pitch angle data of the vehicle body 2 is read from the pitch angle sensor 43. The speed range data of the transmission 34 is read from the transmission speed range sensor 44. The manual drive operation state data of the blade 7 is read from the blade operation sensor 45. If supply voltage is normal, being more than a specified value and the electronic circuit and others are in their normal operating condition, the following data processing will be carried out.

(1) Low frequency components are extracted from the sequential pitch angle data by the frequency separation of the moving average of the pitch angle data, whereby the pitch angle of the vehicle body 2 is obtained.

(2) The acceleration of the vehicle body 2 is obtained by extracting acceleration components by frequency separation in which the low frequency components are deducted from the sequential pitch angle data.

(3) The stroke position data pieces of the right and left blade lift cylinders 11 are averaged to obtain average stroke position data based on which, the average of the angles of the right and left straight frames 8, 9 in relation to the vehicle body 2 is obtained as a straight frame relative angle $\psi_1$.

(4) From the straight frame relative angle $\psi_1$ and the pitch angle of the vehicle body 2 obtained in the way described in the column (1), the average of the angles of the right and left straight frames 8, 9 relative to the ground is obtained as a straight frame absolute angle. Then, a moving average straight frame absolute angle $\psi_2$ is obtained from the moving average of the sequential data on the straight frame absolute angle, which have been read during the period of 5 seconds.

S7 to S11: If the transmission 34 is placed in the first forward speed (F1) or the second forward speed (F2), the actual tractive force $F_R$ is calculated, selecting either of the following ways according to whether the L/U-T/C selection instruction indicates the locked-up state or torque converting state.

Figure 6:
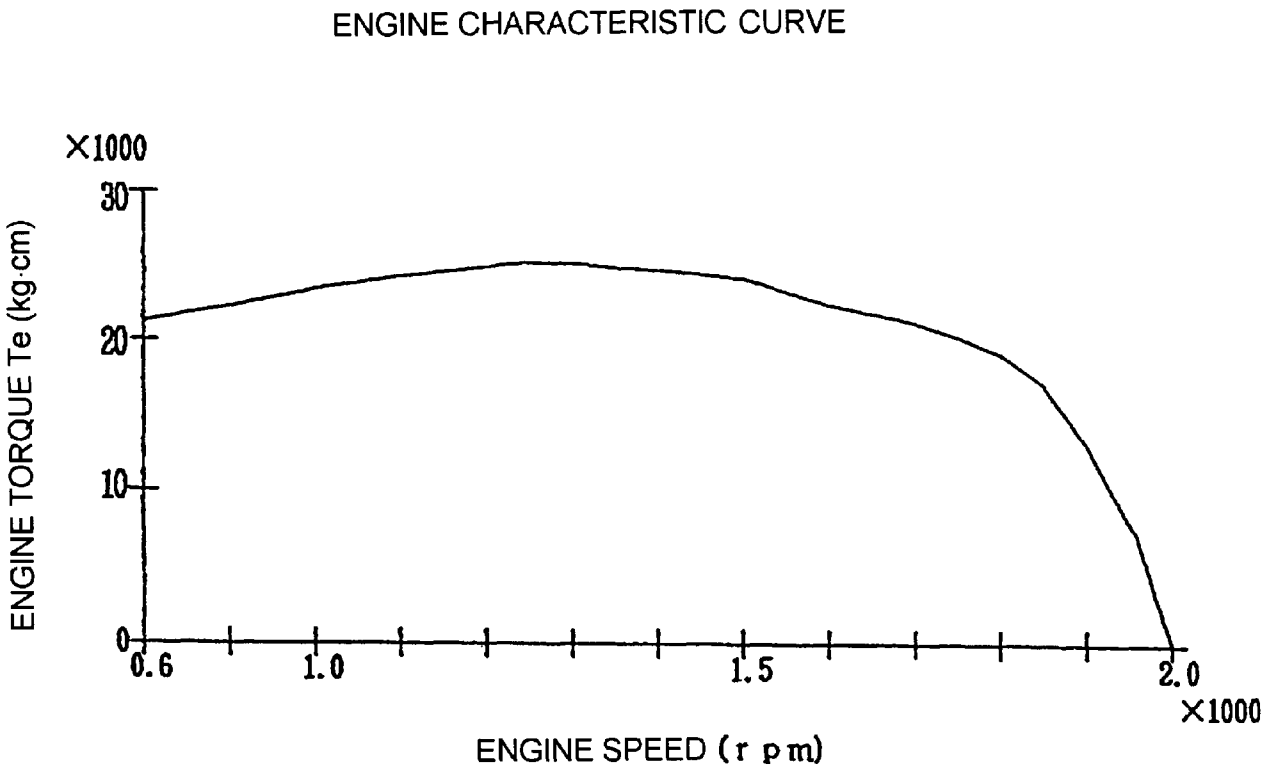
FIG. 6 is a graph of an engine characteristic map.
Figure 7:
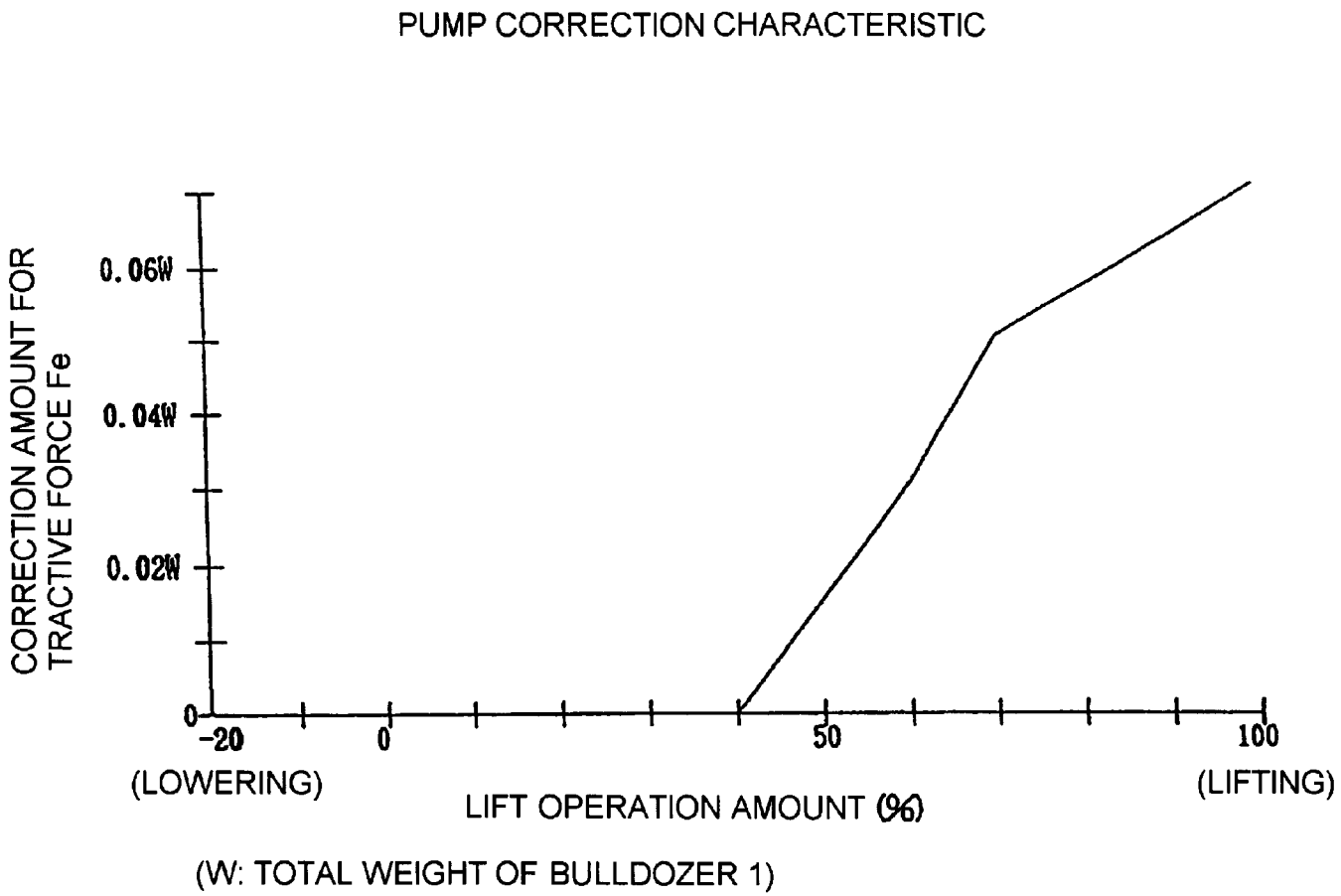
FIG. 7 is a graph of a pump correction characteristic map.

1. Where the torque converter 33 is in the locked-up (LU) state:

Engine torque Te is obtained from the engine characteristic map shown in FIG. 6, based on the engine speed Ne of the engine 30. Then, the engine torque Te is multiplied by a reduction ratio $k_{se}$ from the transmission 34 to the final reduction mechanisms 36 through the steering system 35 (in other words, the reduction ratio between the output shaft of the torque converter 33 and the sprockets 6) and further multiplied by the diameter r of the sprockets 6, to obtain tractive force Fe ($=Te \cdot k_{se} \cdot r$). A tractive force correction value Fc is subtracted from the tractive force Fe, thereby obtaining actual tractive force $F_R$ ($=Fe-Fc$). The tractive force correction value Fc corresponds to the consumption of the hydraulic pumps (e.g., the implement operating hydraulic pump working on the blade lift cylinders 11 in the PTO 32), and can be obtained from the pump correction characteristic map shown in FIG. 7, based on the lift operation amount of the blade 7.

Figure 8:
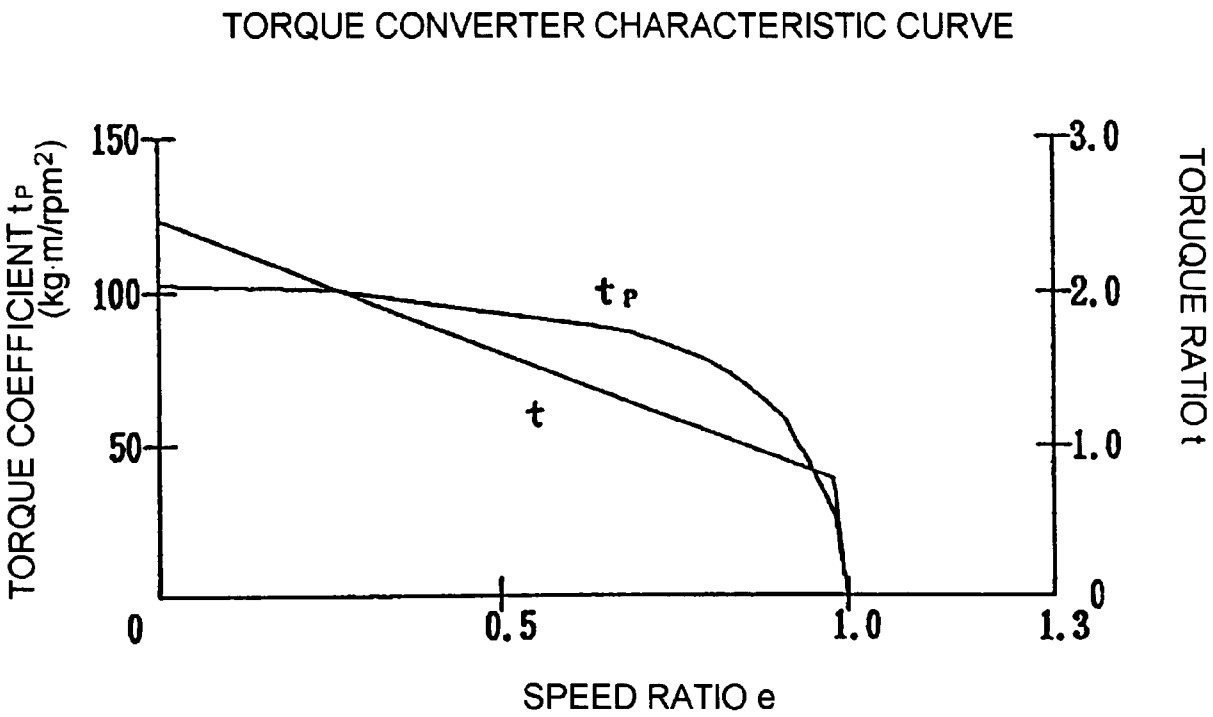
FIG. 8 is a graph of a torque converter characteristic map.

2. Where the torque converter 33 is in the torque converting (TC) state:

A torque coefficient $t_p$ and torque ratio t are obtained from the torque converter characteristic map shown in FIG. 8, based on speed ratio e ($=Nt/Ne$) that is the ratio of the revolution speed Nt of the output shaft of the torque converter 33 to the engine speed Ne of the engine 30, and then torque converter output torque Tc ($=tp \cdot (Ne/1000)^2 \cdot t$) is obtained. Similarly to the case 1, the torque converter output torque Tc is multiplied by the reduction ratio $k_{se}$ between the output shaft of the torque converter 33 and the sprockets 6 and further multiplied by the diameter r of the sprockets 6, to obtain actual tractive force $F_R$ ($=Tc \cdot k_{se} \cdot r$).

Figure 9:
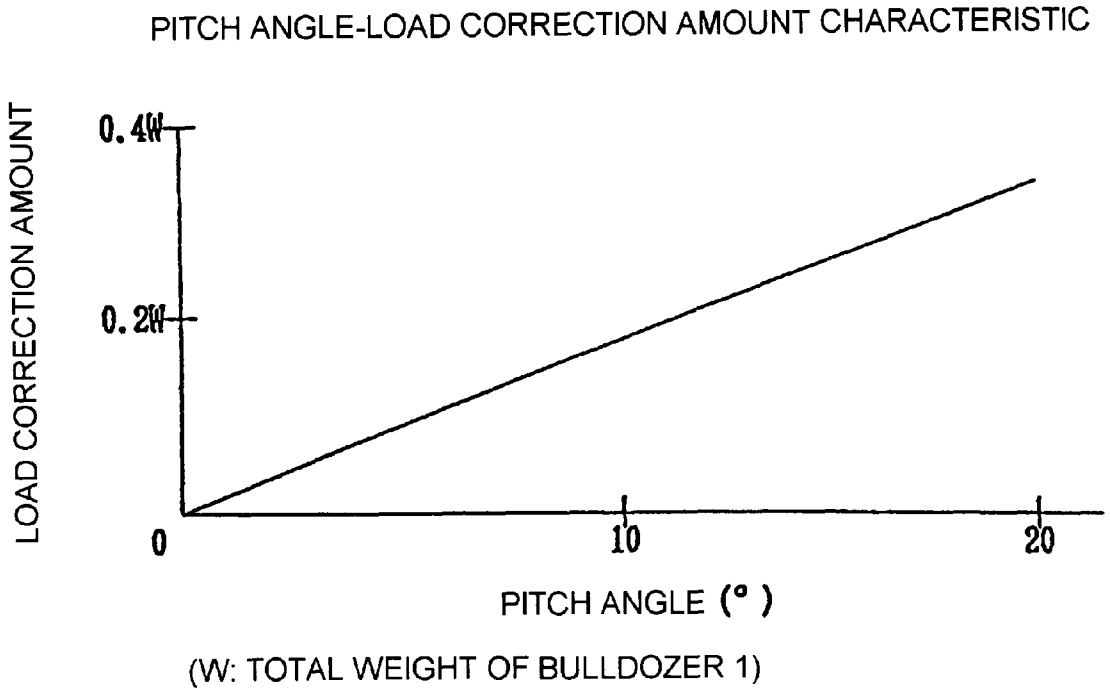
FIG. 9 is a graph of a pitch angle vs. load correction characteristic map.

Then, the load correction value, which corresponds to the pitch angle of the vehicle body 2 and which has been obtained from the pitch angle-load correction characteristic map shown in FIG. 9, is subtracted from the actual tractive force $F_R$, thereby obtaining corrected actual tractive force F.

S12 to S16: If the driving mode selection instruction sent from the automatic/manual driving mode selector switch 20 indicates that the automatic driving mode of dozing operation is selected, the following processing is carried out.

1) If the length of the time during which the automatic/manual driving mode selector switch 20 has been depressed for mode changing is $t_2$ seconds or more, the corrected actual tractive force F is set as a target tractive force $F_0$.

2) If the length of the time during which the automatic/manual driving mode selector switch 20 has been depressed for mode changing is less than $t_2$ seconds, the set value for the load of excavated soil imposed on the blade 7 input by the first dial switch 19A is set as a target tractive force $F_0$.

Then, the target tractive force $F_0$ is increased or decreased by the amount corresponding to the value input by the second dial switch 19B which value is a correction value for the set load value input by the first dial switch 19A, whereby a final target tractive force $F_0$ is determined.

S17 to S19: If $t_3$ seconds or more have elapsed after the automatic driving mode of dozing operation was selected in response to the driving mode selection instruction sent from the automatic/manual driving mode selector switch 20, the moving average straight frame absolute angle $\psi_2$ is set as a target position $\psi_0$ for the cutting edge of the blade 7 relative to the ground. If a time less than $t_3$ seconds has elapsed, the straight frame relative angel $\psi_1$ is set as a target position for the cutting edge of the blade 7 relative to the ground.

Figure 10:
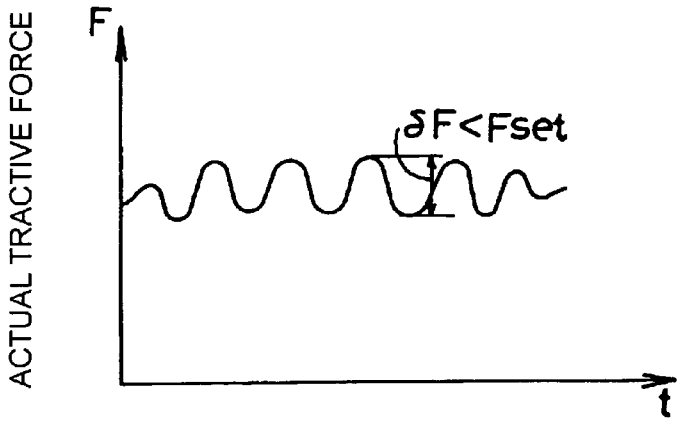
FIG. 10 is a graph showing variations in actual tractive force with time.

S20 to S23: Provided that the operation is not in the manual driving mode, that is, the blade 7 is not manually driven by the blade control lever 18, if a change $\delta F$ in the corrected actual tractive force F is smaller than a specified value $F_{set}$ ($\delta F<F_{set}$) as shown in FIG. 10 and the corrected actual tractive force F is proximate to the target tractive force $F_0$ (i.e., in cases where the load exerted on the blade 7 is judged to be in a stable state), the target cutting edge position $\psi_0$ is corrected to a moving average straight frame absolute angle $\psi_2'$ at that time. On the other hand, if the change $\delta F$ in the corrected actual tractive force F exceeds the specified value $F_{set}$, or if the corrected actual tractive force F differs from the target tractive force $F_0$ more than a certain value (i.e., in cases where the load exerted on the blade 7 is not in a stable state), the flow proceeds to the next step, without correcting the target cutting edge position $\psi_0$.

S24 to S25: The difference $\Delta F$ between the target tractive force $F_0$ and the corrected actual tractive force F and the difference $\Delta\psi$ between the target cutting edge position $\psi_0$ and the moving average straight frame absolute angle $\psi_2$ are obtained while the display unit 22 displays that dozing operation is carried out in the automatic drive mode.

S26 to S28: Whether or not a shoe slip (i.e., running slip) of the vehicle body 2 has occurred is determined in the following way, based on the moving average acceleration and the corrected actual tractive force F. Note that the moving average acceleration is obtained from the moving average of the accelerations of the vehicle body 2 and the accelerations are obtained from acceleration components extracted from the pitch angle data by frequency separation. In the following conditions, $1° \approx 0.0174G$ and W=total weight of the bulldozer 1.

1. If either of the following conditions is satisfied, it is judged that running slip has occurred (1) moving average acceleration $\alpha<-4°$ (2) moving average acceleration $\alpha<-2°$, and corrected actual tractive force $F>0.6W$ 2. If either of the following conditions is satisfied, it is judged that running slip has occurred and then stopped.

(1) moving average acceleration $\alpha>0.1°$ (2) corrected actual tractive force F>corrected actual tractive force F at a start of running slip $-0.1W$ After judging whether or not a running slip has occurred based on the foregoing conditions, the program proceeds to either of the following steps in accordance with a result of the judgment.

1. If an occurrence of running slip is detected, a lift operation amount $Q_S$ for lifting the blade 7 is obtained from a slip control characteristic map (not shown) in order to eliminate the running slip by reducing the load of excavated soil imposed on the blade 7.

2. If no running slip has been detected, lift operation amounts $Q_1$ and $Q_2$ are obtained in the following way.

Figure 11:
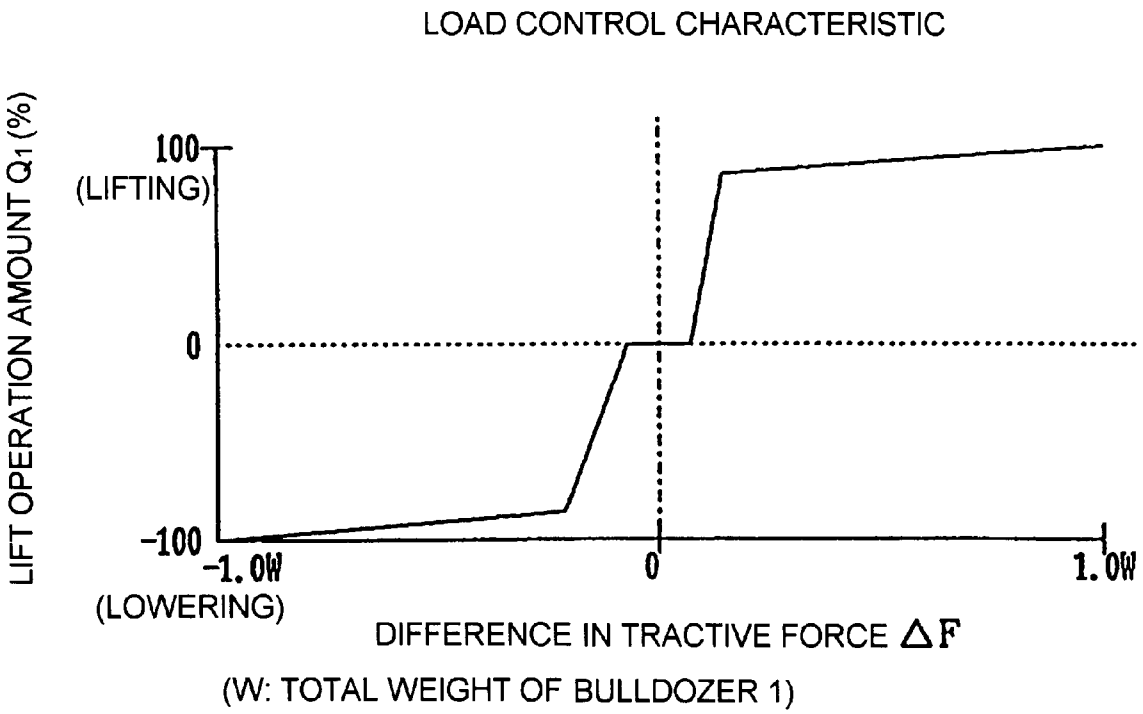
FIG. 11 is a graph of a load control characteristic map.

(1) The lift operation amount $Q_1$ for lifting or lowering the blade 7 such that the corrected actual tractive force F is made equal to the target tractive force $F_0$ is obtained from the load control characteristic map shown in FIG. 11, based on the difference ΔF between the target tractive force $F_0$ and the corrected actual tractive force F.

Figure 12:
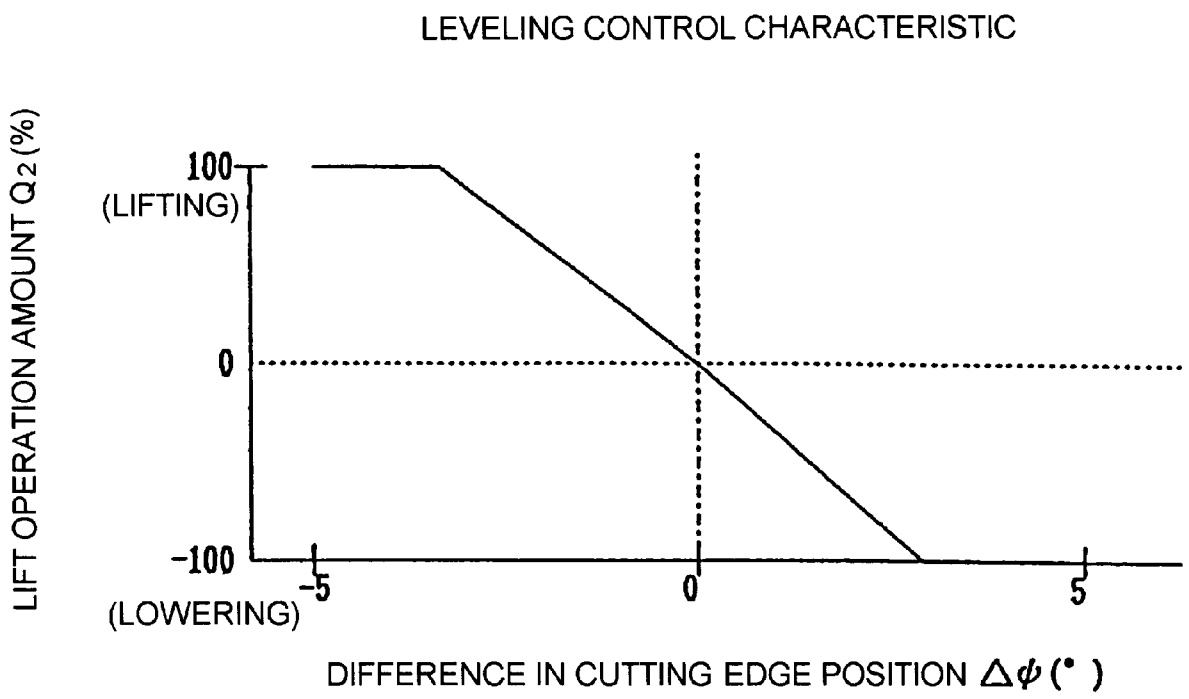
FIG. 12 is a graph of a leveling control characteristic map.

(2) The lift operation amount $Q_2$ for lifting or lowering the blade 7 such that the moving average straight frame absolute angle $\psi_2$ is made equal to the target cutting edge position $\psi_0$ is obtained from the leveling control characteristic map shown in FIG. 12, based on the difference $\Delta\psi$ between the target cutting edge position $\psi_0$ and the moving average straight frame absolute angle $\psi_2$.

Figure 13:
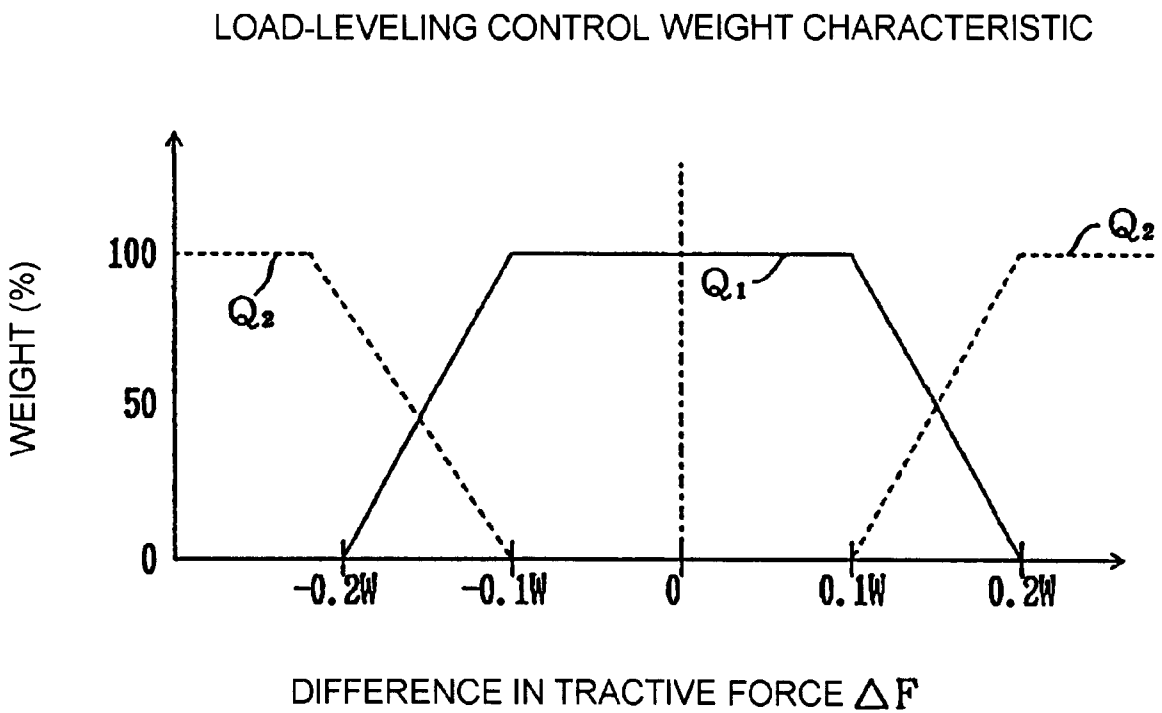
FIG. 13 is a graph of a load vs. weight for leveling control characteristic map.

(3) A lift operation amount $Q_T$ is obtained by obtaining the sum of the lift operation amounts $Q_1$ and $Q_2$ which are weighted based on the tractive force difference ΔF according to the load-leveling control weight characteristic map shown in FIG. 13. According to the weighting map of FIG. 13, if the tractive force difference ΔF is within ±0.1W, priority is given to the load control.

If supply voltage is not normal, being equal to or lower than the specified voltage and the electronic circuit etc. is not in a normal driving condition, or if the transmission 34 is placed neither in the first forward speed (F1) nor in the second forward speed (F2), or if the driving mode selection instruction sent from the automatic/manual driving mode selector switch 20 indicates a selection of the manual driving mode of dozing operation, or if the blade 7 is manually driven by the blade control lever 18, a lift operation amount $Q_N$ for lifting or lowering the blade 7 in Step S29 is obtained from a manual control characteristic map (not shown), according to the operation amount of the blade control lever 18.

Then, the lift operation amounts $Q_S$, $Q_T$, $Q_N$ are supplied to the blade lift cylinder controller 46. According to the lift operation amounts $Q_S$, $Q_T$, $Q_N$, the blade lift cylinders 11 are driven through the lift valve actuator 47 and the lift cylinder control valve 48, and in this way, the desired control for lifting or lowering the blade 7 is carried out.

According to the present embodiment, a target value for the smoothing control is corrected so as to be equal to the level of the blade 7 when the load exerted on the blade 7 is in a stable state. Therefore, the blade 7 can be accurately controlled, with a load proximate to a target value for the load control. With this arrangement, such an undesirable inconsistent situation can be avoided that, upon completion of carrying, the load control is so performed as to lift the blade 7 while the smoothing control is so performed as to lower the blade 7 for the purpose of reducing the amount of a change in the target position of the cutting edge. As a result, the face of an excavation can be flattened.

While the first embodiment is arranged such that the target cutting edge position $\psi_0$ is corrected to the moving average straight frame absolute angle $\psi_2'$ obtained when the load exerted on the blade 7 comes in a stable state, the straight frame absolute angle obtained when the blade 7 becomes stable may be set as a target cutting edge position, instead of using the moving average.

According to the present embodiment, a judgement as to whether a change in the load exerted on the blade 7 is small is made by determining whether the amount of a change δF in the corrected actual tractive force F is lower than the specified value $F_{set}$. This judgement may be made by determining whether or not a change in the position of the cutting edge is lower than a specified value. Alternatively, the judgement may be made by determining whether the time differential of the amount of the change δF is lower than a preset value or whether the time differential of the amount of a change in the position of the cutting edge is lower than a preset value. Any one of these judgement methods may be taken solely or a plurality of methods may be used in combination.

SECOND EMBODIMENT

The second embodiment does not differ from the first embodiment in terms of the construction of the bulldozer 1, the system structure and the basic part of the flow chart associated with the operation of the dozing system. Therefore, the explanation of the parts common to both embodiments will be omitted and the features inherent to the second embodiment only will be explained in the following description (the same will be applied to the description of the third and forth embodiments).

The second embodiment is designed such that whether the bulldozer 1 is in automatic digging operation or in automatic carrying operation is judged according to the loading ratio of the blade and the condition of the load imposed on the blade. Based on the operation of the bulldozer 1 determined by the judgment, the load-leveling control weight characteristic (see FIG. 13 in the first embodiment) is varied.

The operation of the dozing system for a bulldozer according to the second embodiment is described in Step S21 and forward in the flow chart of FIG. 14 which correspond to Step S21 and forward in FIG. 5. Now, referring to FIG. 14, the operation will be hereinafter explained.

S20 to S22: Provided that the operation is not in the manual driving mode, that is, the blade 7 is not manually driven by the blade control lever 18, the difference ΔF between the target tractive force $F_0$ and the corrected actual tractive force F and the difference $\Delta\psi$ between the target cutting edge position $\psi_0$ and the moving average straight frame absolute angle $\psi_2$ are obtained, and the display unit 22 indicates that the dozing operation is in the automatic driving mode.

S23 to S29: Whether or not a running slip of the vehicle body 2 has occurred is determined, according to which either of the following processes will be taken.

1. If an occurrence of running slip is detected, a lift operation amount $Q_S$ for lifting the blade 7 is obtained from a slip control characteristic map (not shown) in order to eliminate the running slip by reducing the load of excavated soil imposed on the blade 7.

2. If no running slip has been detected, lift operation amounts $Q_1$ and $Q_2$ are obtained in the following way.

(1) The lift operation amount $Q_1$ for lifting or lowering the blade 7 such that the corrected actual tractive force F is made equal to the target tractive force $F_0$ is obtained from the load control characteristic map shown in FIG. 11, based on the difference ΔF between the target tractive force $F_0$ and the corrected actual tractive force F.

(2) The lift operation amount $Q_2$ for lifting or lowering the blade 7 such that the moving average straight frame absolute angle $\psi_2$ is made coincident with the target cutting edge position $\psi_0$ is obtained from the leveling control characteristic map shown in FIG. 12, based on the difference $\Delta\psi$ between the target cutting edge position $\psi_0$ and the moving average straight frame absolute angle $\psi_2$.

Figure 15:
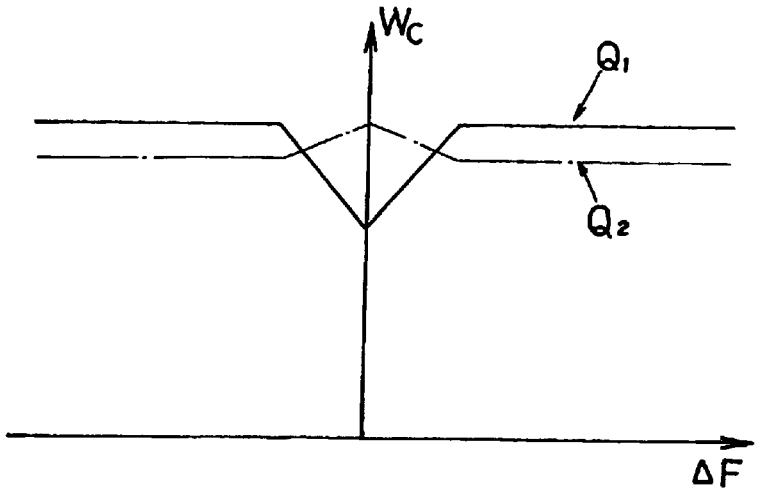
FIG. 15 is a graph of a weight characteristic map for automatic carrying operation.
Figure 16:
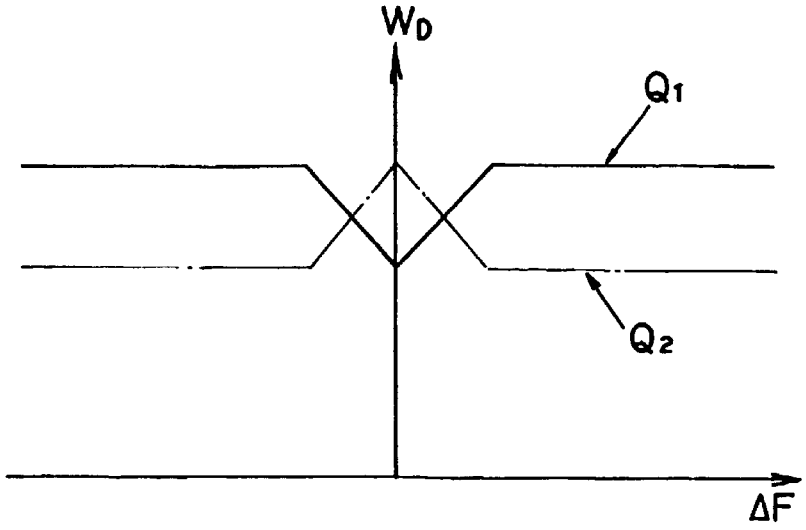
FIG. 16 is a graph of a weight characteristic map for automatic digging operation.

(3) The loading ratio of the front surface of the blade 7 is detected. If the loading ratio is equal to or more than a preset value, the amount of the change $\delta F$ in the corrected actual tractive force is a small value less than the preset value $F_{set}$, and the corrected actual tractive force F is proximate to the target tractive force $F_0$, importance is given to weighting of the lift operation amount $Q_2$ in the smoothing control (leveling control) over weighting of the lift operation amount $Q_1$ in the load control, as shown in FIG. 15. Stated another way, if the above conditions are met, a weight characteristic (weight function) $W_c$ for automatic carrying operation for smoothing the face of an excavation is selected, and a lift operation amount $Q_T$ is obtained based on the tractive force difference $\Delta F$ that is weighted according to this weight characteristic map. On the other hand, if any one of the above conditions is not satisfied, that is, if the loading ratio is a small value less than the preset value, or if the amount of the change $\delta F$ in the corrected actual tractive force is equal to or more than the preset value $F_{set}$, or if the corrected actual tractive force F differs considerably from the target tractive force $F_0$, importance is given to weighting of the lift operation amount $Q_1$ in the load control over weighting of the lift operation amount $Q_2$ in the smoothing control, as shown in FIG. 16. In other words, a weight characteristic (weight function) $W_D$ for automatic digging operation stressed on the load control is selected and a lift operation amount $Q_T$ is obtained based on the tractive force difference $\Delta F$ that is weighted according to this weight characteristic map.

The loading ratio is detected in the following way. First, the corrected actual tractive force F is calculated as described earlier and regarded as a horizontal reactive force $F_H$ exerted on the blade 7. Then, an axial force $F_c$ exerted on the cylinder rod of the blade lift cylinders 11 is obtained and the yoke angle $\theta$ of the blade lift cylinders 11 is obtained with a yoke angle sensor. From the axial force $F_c$ and the yoke angle $\theta$, a vertical reactive force $F_v$ imposed on the blade 7 is obtained, using the following equation.

$$F_v = F_c \cos\theta$$

The ratio of the vertical reactive force $F_v$ to the horizontal reactive force ($F_v/F_H$) is calculated and then, the loading ratio corresponding to the ratio $F_v/F_H$ and to the pitch angle is obtained from the map.

In the second embodiment, the weight characteristic $W_c$ for automatic carrying operation is selected on condition that the requirement for the loading ratio of the blade is satisfied and the load exerted on the blade is stable (i.e., the amount of the change $\delta F$ in the corrected actual tractive force F is lower than the specified value $F_{set}$ and the corrected actual tractive force F is proximate to the target tractive force $F_0$). It is also possible to select the weight characteristic $W_c$ for automatic carrying operation when either of these conditions is met.

THIRD EMBODIMENT

Figure 17:
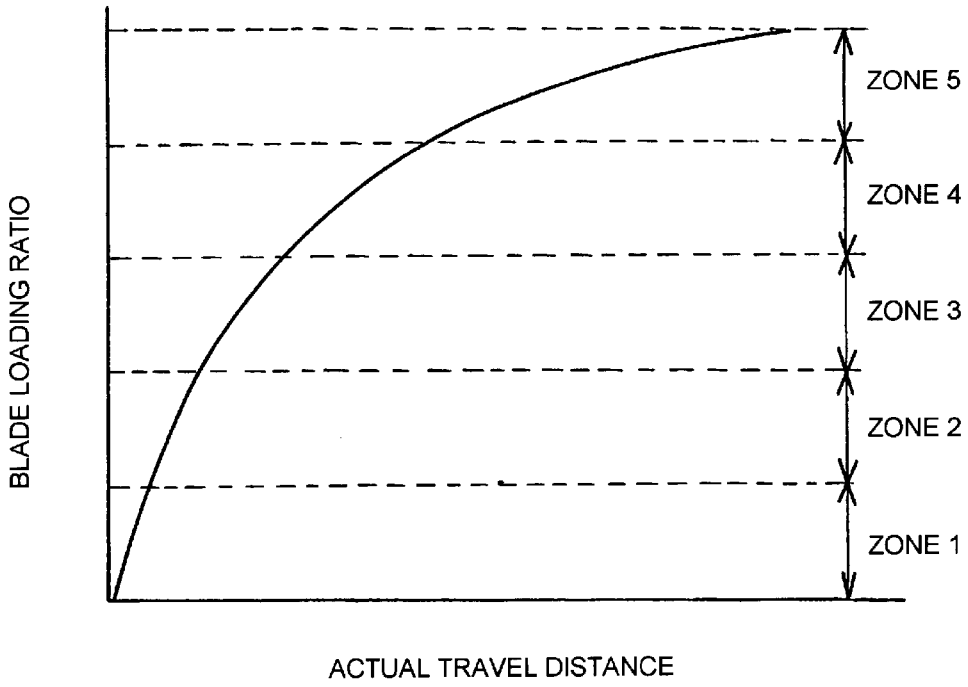
FIG. 17 is a graph showing the relationship between actual travel distance and loading ratio in a third embodiment.

The second embodiment uses two types of weight characteristics, that is, one for automatic digging operation and the other for automatic carrying operation, depending on the working state of dozing operation. In contrast with this, in the third embodiment, the relationship between the actual traveling distance of the bulldozer 1 and the loading ratio of the blade as shown in FIG. 17 is taken into account and different weight characteristics are selectively used according to which of the loading ratio zones the present loading ratio belongs to. Note that the value of the loading ratio is stratified into zones 1, 2, 3, 4 and 5 in this embodiment. The weight characteristic corresponding to the detected value of the loading ratio is read from the memory and a final lift operation amount $Q_T$ is determined according to the weight characteristic thus read.

The third embodiment can ensure more accurate blade control compared to the second embodiment.

FORTH EMBODIMENT

Figure 18:
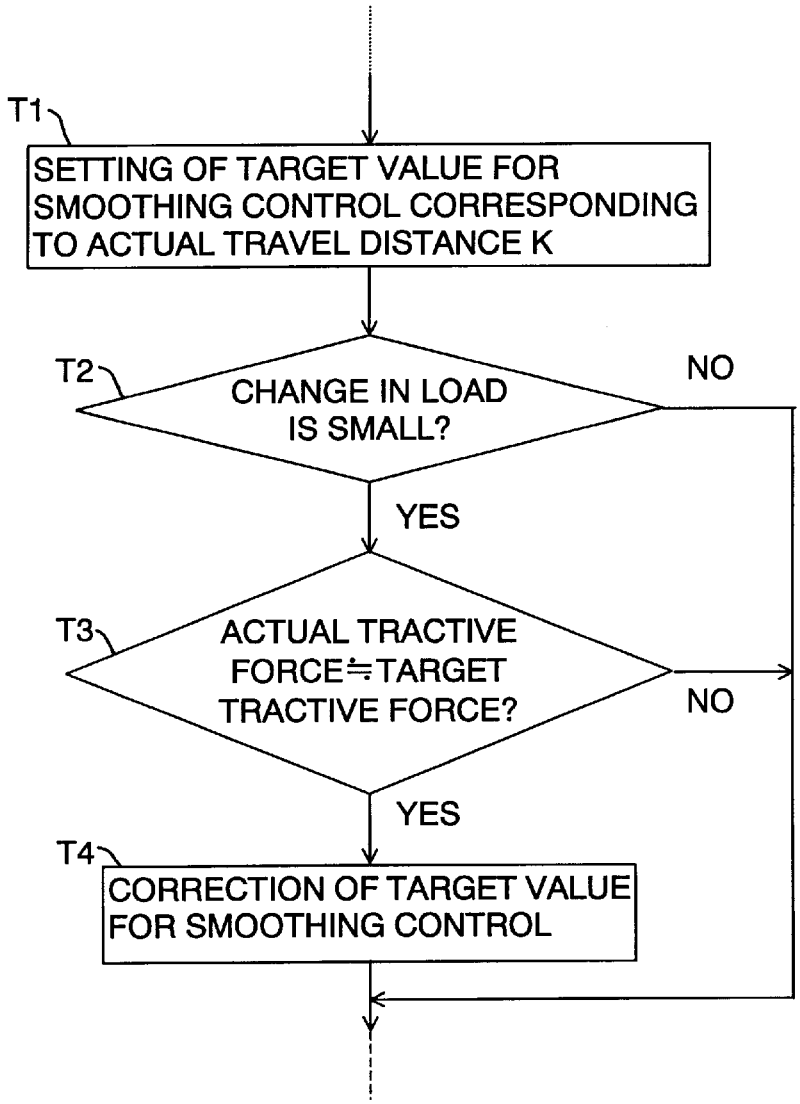
FIG. 18 is a flow chart of the important part of the operation of the dozing system according to a forth embodiment.

In the forth embodiment, a map for correlating the actual travel distance from a digging start point with the position of the blade cutting edge relative to the ground is prepared in every cycle of dozing operation. In the respective cycles, stable cutting edge positions are accumulated and averaged, thereby obtaining an optimum target value for the smoothing control. The processes inherent to this embodiment are carried out in Steps T1 to T4 (see FIG. 18) which replace Steps 21 to S23 of the first embodiment (see FIG. 5). The flow of these steps will be described below.

Figure 19:
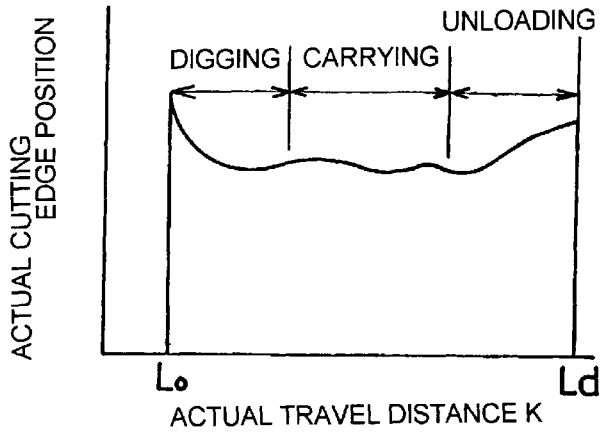
FIGS. 19(*a*), 19(*b*), and 19(*c*) are graphs for explaining the content of the control performed by the dozing system according to the forth embodiment.
Figure 19:
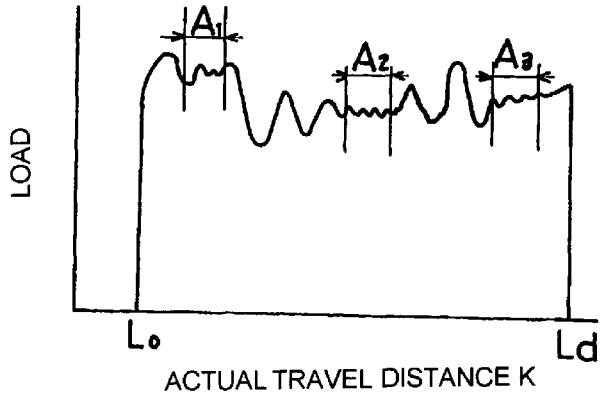
Figure 19:
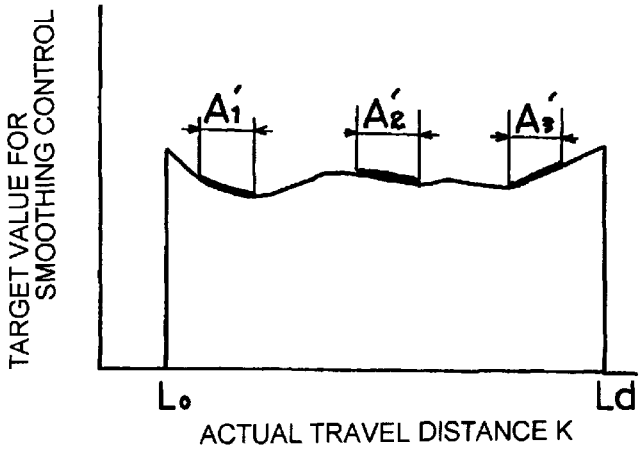

T1: A map for correlating the actual travel distance K of the bulldozer 1 with the target position of the cutting edge (i.e., target values for the smoothing control) is initialized. This map is set, as shown in FIG. 19(*a*), by determining target values for digging operation according to the distance from a digging start point $L_0$ or alternatively by determining target values for carrying operation according to the distance from a carrying start point $L_d$.

T2 to T4: If the amount of the change $\delta F$ in the corrected actual tractive force F is a small value that is less than the preset value $F_{set}$, and the corrected actual tractive force F becomes proximate to the target tractive force $F_0$ (i.e., the load exerted on the blade becomes stable), a target value for the position of the cutting edge when the load is in a stable state is corrected. Such corrected data are accumulated and averaged to obtain an optimum target value. In this way, the soil properties and working conditions in the excavation site can be learned, and as a result, dozing operation can be automated so as to conform to working conditions which vary every excavation site. In FIG. 19(*b*), $A_1$, $A_2$ and $A_3$ represent stable load regions. $A_1'$, $A_2'$, and $A_3'$ in FIG. 19(*c*) represent the ranges of target values corresponding to the stable load regions $A_1$, $A_2$ and $A_3$.

According to the first to forth embodiments, the actual tractive force is obtained by calculation, but it may be obtained from a driving torque amount detected by a driving torque sensor for sensing the driving torque of the sprockets 6. Alternatively, there may be provided a bending stress sensor which senses the bending stress of the straight frames 8, 9 for supporting the blade 7 at the trunnions 10, and the actual tractive force may be obtained from the bending stress sensed by this bending stress sensor.

While the torque converter unit 33 with a lock-up mechanism is incorporated in the power transmission system according to the foregoing embodiments, the invention may, of course, be applied to cases where a torque converter having no lock-up mechanism or a direct transmission having no torque converter is used. In cases where a direct transmission is used, the actual tractive force can be calculated in the same way as described in the case of "the locked-up state" in the foregoing embodiment.

While the running slip of the vehicle body 2 is detected by extracting acceleration components from pitch angle data output from the pitch angle sensor 43 by frequency separation in the foregoing embodiments, it may be detected from the output of the acceleration sensor, the output indicating the acceleration condition of the vehicle body 2. It is also possible to detect the running slip by comparing the actual speed of the vehicle body 2 obtained from a Doppler speed meter with the travel speed of the crawler belts 5 which run the vehicle body 2.

Although a target position for the cutting edge in relation to the ground is set by calculation in the foregoing embodiments, it may be set by a dial switch in the similar way to setting of a target tractive force.

What is claimed is:

1. A dozing system for use in a bulldozer, the system comprising:

(a) cutting edge position detecting means for detecting the position of the cutting edge of a blade in relation to the ground;

(b) target cutting edge position setting means for setting a target position of the cutting edge of the blade in relation to the ground;

(c) load condition detecting means for determining whether the load exerted on the blade is in a stable state;

(d) target cutting edge position correcting means for correcting the target cutting edge position set by the target cutting edge position setting means to the actual position of the cutting edge at that time, if the load condition detecting means determines that the load exerted on the blade is in a stable state when dozing operation is performed in an automatic digging mode; and (e) blade controlling means for controlling the blade to be lifted or lowered such that the position of the cutting edge of the blade detected by the cutting edge position detecting means is made coincident with the target cutting edge position corrected by the target cutting edge position correcting means.

2. A dozing system for use in a bulldozer according to claim 1, wherein the actual position of the cutting edge used for correcting the target cutting edge position by the target cutting edge position correcting means is obtained from a moving average.

3. A dozing system for use in a bulldozer, the system comprising:

(a) actual tractive force detecting means for detecting the actual tractive force of a vehicle body;

(b) cutting edge position detecting means for detecting the position of the cutting edge of a blade in relation to the ground;

(c) loading ratio detecting means for detecting a loading ratio that is the ratio of the amount of excavated soil loaded on the front surface of the blade to the loading capacity of the blade front surface;

(d) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(e) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(f) weight characteristic setting means for setting a weight characteristic for automatic digging, which gives importance to weighting of the operation amount calculated by the first operation amount calculating means rather than weighting of the operation amount calculated by the second operation amount calculating means, if the loading ratio determined by the loading ratio detecting means is below a specified value, and for setting a weight characteristic for automatic carrying, which gives importance to weighting of the operation amount calculated by the second operation amount calculating means rather than weighting of the operation amount calculated by the first operation amount calculating means, if the loading ratio determined by the loading ratio detecting means is equal to or more than the specified value; and (g) blade controlling means for controlling the blade to be lifted or lowered, using the weight characteristic set by the weight characteristic setting means.

4. A dozing system for use in a bulldozer, the system comprising:

(a) actual tractive force detecting means for detecting the actual tractive force of a vehicle body;

(b) cutting edge position detecting means for detecting the position of the cutting edge of a blade in relation to the ground;

(c) load condition detecting means for determining whether the load exerted on the blade is in a stable state;

(d) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(e) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(f) weight characteristic setting means for setting a weight characteristic for automatic digging, which gives importance to weighting of the operation amount calculated by the first operation amount calculating means rather than weighting of the operation amount calculated by the second operation amount calculating means, if the load condition detecting means determines that the load on the blade is not in a stable state, and for setting a weight characteristic for automatic carrying, which gives importance to weighting of the operation amount calculated by the second operation amount calculating means rather than weighting of the operation amount calculated by the first operation amount calculating means, if the load condition detecting means determines that the load on the blade is in a stable state; and (g) blade controlling means for controlling the blade to be lifted or lowered, using the weight characteristic set by the weight characteristic setting means.

5. A dozing system for use in a bulldozer, the system comprising:

(a) actual tractive force detecting means for detecting the actual tractive force of a vehicle body;

(b) cutting edge position detecting means for detecting the position of the cutting edge of a blade in relation to the ground;

(c) loading ratio detecting means for detecting a loading ratio that is the ratio of the amount of excavated soil loaded on the front surface of the blade to the loading capacity of the blade front surface;

(d) load condition detecting means for determining whether the load exerted on the blade is in a stable state;

(e) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(f) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(g) weight characteristic setting means for setting a weight characteristic for automatic digging, which gives importance to weighting of the operation amount calculated by the first operation amount calculating means rather than weighting of the operation amount calculated by the second operation amount calculating means, if the loading ratio determined by the loading ratio detecting means is below a specified value or if the load condition detecting means determines that the load on the blade is not in a stable state, and for setting a weight characteristic for automatic carrying, which gives importance to weighting of the operation amount calculated by the second operation amount calculating means rather than weighting of the operation amount calculated by the first operation amount calculating means, if the loading ratio is equal to or more than the specified value and the load condition detecting means determines that the load on the blade is in a stable state; and (h) blade controlling means for controlling the blade to be lifted or lowered, using the weight characteristic set by the weight characteristic setting means.

6. A dozing system for use in a bulldozer, the system comprising:

(a) actual tractive force detecting means for detecting the actual tractive force of a vehicle body;

(b) cutting edge position detecting means for detecting the position of the cutting edge of a blade in relation to the ground;

(c) loading ratio detecting means for detecting a loading ratio that is the ratio of the amount of excavated soil loaded on the front surface of the blade to the loading capacity of the blade front surface;

(d) first operation amount calculating means for calculating an operating amount for controlling the blade to be lifted or lowered such that the actual tractive force detected by the actual tractive force detecting means is made equal to a preset target tractive force if there is a difference between the actual tractive force and the preset target tractive force;

(e) second operation amount calculating means for calculating an operating amount for controlling the blade to be lifted or lowered such that the actual position of the cutting edge detected by the actual cutting edge position detecting means is made coincident with a preset target cutting edge position if there is a difference between the actual cutting edge position and the preset target cutting edge position;

(f) weight characteristic setting means for setting an adequate weight characteristic that is retrieved from prestored data by the loading ratio detected by the loading ratio detecting means, said prestored data correlating weight characteristics for operation amounts calculated by the first operation amount calculating means and calculated by the second operation amount calculating means with a multiplicity of zones into which the value of loading ratio is stratified; and (g) blade controlling means for controlling the blade to be lifted or lowered, using the weight characteristic set by the weight characteristic setting means.

7. A dozing system for use in a bulldozer, the system comprising:

(a) cutting edge position detecting means for detecting the position of the cutting edge of a blade in relation to the ground;

(b) target cutting edge position setting means for setting the relationship between the actual travel distance of the bulldozer from a digging start point and target positions for the cutting edge of the blade in relation to the ground;

(c) load condition detecting means for determining whether the load exerted on the blade is in a stable state;

(d) target cutting edge position correcting means for accumulating a sequence of data on the position of the cutting edge in each dozing operation cycle when the load condition detecting means determines the load exerted on the blade is in a stable state during dozing operation carried out in an automatic driving mode, and for correcting the target cutting edge position set by the target cutting edge position setting means to a value obtained by averaging the sequence of accumulated cutting edge position data; and (e) blade controlling means for controlling the blade to be lifted or lowered such that a cutting edge position detected by the cutting edge position detecting means is made coincident with the target cutting edge position corrected by the target cutting edge position correcting means.

8. A dozing system for a bulldozer according to claim 1, 4, 5, or 7, wherein the load condition detecting means determine that the load exerted on the blade is in a stable state, when a change in the load on the blade is below a specified value and the load on the blade is proximate to a preset target tractive force.

9. A dozing system for a bulldozer according to claim 8, wherein the magnitude of a change in the load exerted on the blade is determined by sensing a change in the actual tractive force of the vehicle body.

10. A dozing system for a bulldozer according to claim 8, wherein the magnitude of a change in the load exerted on the blade is determined by sensing a change in the position of the cutting edge of the blade relative to the ground.

* * * * *

UNITED STATES PATENT AND TRADEMARK OFFICE

CERTIFICATE OF CORRECTION

PATENT NO. : 6,181,999 B1
DATED : January 30, 2001
INVENTOR(S) : Shigeru Yamamoto et al.

It is certified that error appears in the above-identified patent and that said Letters Patent is hereby corrected as shown below:

Title page,
Item [54] should read -- DOZING SYSTEM FOR BULLDOZER --.

Signed and Sealed this

Second Day of October, 2001

*Attest:*

Nicholas P. Godici

NICHOLAS P. GODICI
*Acting Director of the United States Patent and Trademark Office*

*Attesting Officer*